US009969582B2

(12) United States Patent
Morimoto et al.

(10) Patent No.: US 9,969,582 B2
(45) Date of Patent: May 15, 2018

(54) SHEET CONVEYANCE DEVICE AND IMAGE FORMING APPARATUS INCLUDING THE SAME

(71) Applicant: Sharp Kabushiki Kaisha, Sakai, Osaka (JP)

(72) Inventors: Yasumasa Morimoto, Sakai (JP); Hironori Ogasawara, Sakai (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days. days.

(21) Appl. No.: 15/292,408

(22) Filed: Oct. 13, 2016

(65) Prior Publication Data

US 2017/0108814 A1 Apr. 20, 2017

(30) Foreign Application Priority Data

Oct. 14, 2015 (JP) ..... 2015-203176

(51) Int. Cl.
*B65H 5/02* (2006.01)
*B65H 5/04* (2006.01)
(Continued)

(52) U.S. Cl.
CPC ..... *B65H 7/20* (2013.01); *B65H 5/062* (2013.01); *B65H 7/00* (2013.01); *G03G 15/602* (2013.01); *G03G 15/6529* (2013.01); *B65H 2404/144* (2013.01); *B65H 2404/1441* (2013.01); *B65H 2513/53* (2013.01); *B65H 2555/13* (2013.01); *B65H 2555/23* (2013.01); *G03G 15/80* (2013.01)

(58) Field of Classification Search
CPC ..... B65H 5/062; B65H 7/20; B65H 29/12; B65H 29/125; B65H 2404/144; B65H 2404/1441; B65H 2404/1442; B65H 2555/13; B65H 2555/23
See application file for complete search history.

(56) References Cited

U.S. PATENT DOCUMENTS 8,328,192 B2 * 12/2012 Yamazaki ..... B65H 7/02 271/262
2005/0219645 A1 * 10/2005 Maruchi ..... B65H 5/062 358/474

(Continued)

FOREIGN PATENT DOCUMENTS

JP 2004-123354 4/2004

*Primary Examiner* — Prasad V Gokhale
(74) *Attorney, Agent, or Firm* — Keating & Bennett, LLP

(57) ABSTRACT

A sheet conveyance device includes a pair of separable contact rollers configured to convey a sheet, a contact/separation mechanism configured to support the pair of separable contact rollers in such a manner that the pair of separable contact rollers are able to come into separable contact with each other, and a solenoid configured to operate the contact/separation mechanism. The solenoid is driven so that the contact/separation mechanism causes the pair of separable contact rollers to come into pressure contact with each other, and driving of the solenoid is cancelled so that the contact/separation mechanism causes the pair of separable contact rollers to be separated from each other. Pulse width modulation duty control is performed on the solenoid while the pair of separable contact rollers are in pressure contact with each other when a plurality of the sheets are conveyed one by one at an interval.

14 Claims, 16 Drawing Sheets

(51) Int. Cl.

| | |
|---|---|
| ***B65H 7/20*** | (2006.01) |
| ***B65H 5/06*** | (2006.01) |
| ***B65H 7/00*** | (2006.01) |
| ***G03G 15/00*** | (2006.01) |

(56) References Cited

U.S. PATENT DOCUMENTS

| | | | | |
|---|---|---|---|---|
| 2009/0152792 | A1* | 6/2009 | Kato | B65H 3/0684 271/8.1 |
| 2011/0204562 | A1* | 8/2011 | Peterson | B43M 3/045 271/253 |
| 2013/0069300 | A1* | 3/2013 | Tamehira | B65H 85/00 271/10.13 |
| 2014/0361481 | A1* | 12/2014 | Hong | B65H 5/26 271/3.19 |
| 2015/0084264 | A1* | 3/2015 | Hino | B65H 85/00 271/3.18 |
| 2015/0362874 | A1* | 12/2015 | Morimoto | B65H 29/14 399/365 |

* cited by examiner (CONVENTIONAL CONFIGURATION)

(FIRST EMBODIMENT)

(SECOND EMBODIMENT)

(THIRD EMBODIMENT)

(FOURTH EMBODIMENT)

SHEET CONVEYANCE DEVICE AND IMAGE FORMING APPARATUS INCLUDING THE SAME

CROSS-REFERENCE TO RELATED APPLICATIONS

The present application claims the benefit of priority to Japanese Unexamined Patent Application Publication No. 2015-203176, the entirety of which is incorporated herein by reference, filed on Oct. 14, 2015 under Section 119(*a*) of 35 U.S.C.

BACKGROUND ART

Field of the Invention

The present invention relates to a sheet conveyance device and to an image forming apparatus, such as a copier, a multifunction peripheral (MFP), and a facsimile machine, including the same.

Description of the Related Art

A sheet conveyance device includes: a pair of separable contact rollers for conveying a sheet; a contact/separation mechanism that supports the pair of separable contact rollers in such a manner that the pair of separable contact rollers are able to come into separable contact with each other; and a solenoid that operates the contact/separation mechanism. The sheet conveyance device drives the solenoid so that the contact/separation mechanism causes the pair of separable contact rollers to come into pressure contact with each other, and cancels the driving of the solenoid so that the contact/separation mechanism causes the pair of separable contact rollers to be separated from each other.

For example, the sheet conveyance device further includes a document moving reading structure that reads a document image while moving a document as the sheet. In this configuration, the pair of separable contact rollers are components of the document moving reading structure, and are disposed more on a downstream side than a reading position for the document, in a conveyance direction of the document.

Such a sheet conveyance device conveys a plurality of the sheets one by one at an interval based on the following rule to prevent the temperature rise of the solenoid that has been energized. Specifically, the solenoid is driven only in a period during which the pair of separable contact rollers are to be in pressure contact with each other (for example, a sheet passing period during which the sheets pass through the pair of separable contact rollers) (a pressure-contact period), and is not driven in the other (for example, an inter-document non-passing period between conveyance operations respectively for two consecutive documents to be conveyed by the pair of separable contact rollers) (a non-pressure-contact period).

In other words, in this conventional control configuration, a plurality of the sheets have been conveyed one by one at an interval with a solenoid driving operation and a solenoid driving cancel operation repeatedly performed. The solenoid driving operation is an operation of driving the solenoid to put the pair of separable contact rollers in a pressure-contact state, and is performed in the pressure-contact period in which the pair of separable contact rollers are to be in pressure contact with each other in the sheet passing period. The solenoid driving cancel operation is an operation of canceling the driving of the solenoid to put the pair of separable contact rollers in a separated state, and is performed in the non-pressure-contact period other than the pressure-contact period.

The conventional control configuration, in which the plurality of the sheets have been conveyed one by one at an interval with the solenoid driving operation and the solenoid driving cancel operation repeatedly performed, has the following disadvantage. More specifically, the operations of putting the pair of separable contact rollers in the pressure-contact state and to the separated state are repeated every time a sheet passes. Thus, the solenoid driving operations and the solenoid driving cancel operations are repeated, causing intermittent operating noise of the solenoid (more specifically, the operating noise of the pair of separable contact rollers), which can make a user irritated.

Japanese Unexamined Patent Application Publication No. 2004-123354 describes a technique related to the present invention. More specifically, Japanese Unexamined Patent Application Publication No. 2004-123354 describes a sheet conveyance device including a document moving reading structure that reads a document image while moving a document as the sheet. The document moving reading structure includes a pair of separable contact rollers disposed more on the downstream side than a reading position for the document in a conveyance direction of the document. In this configuration, a first pulse driving of a solenoid starts before the trailing edge of the document passes through the reading position, and then a second pulse driving of the solenoid starts after the trailing edge of the document has passed through the reading position.

The sheet conveyance device described in Japanese Unexamined Patent Application Publication No. 2004-123354 has no countermeasure against the temperature rise of the solenoid that has been energized and against the generation of the intermittent operating noise of the solenoid due to the solenoid driving operation and the solenoid driving cancel operation repeated.

All things considered, an object of the present invention is to provide a sheet conveyance device that can prevent the temperature rise of the solenoid that has been energized, and also can prevent the intermittent operating noise of the solenoid from being generated due to the solenoid driving operation and the solenoid driving cancel operation repeated, and thus can effectively overcome the disadvantage that the operating noise of the solenoid can make the user irritated, and to provide an image forming apparatus including the sheet conveyance device.

SUMMARY OF THE INVENTION

To solve the object, a sheet conveyance device according to the present invention includes a pair of separable contact rollers configured to convey a sheet, a contact/separation mechanism configured to support the pair of separable contact rollers in such a manner that the pair of separable contact rollers are able to come into separable contact with each other, and a solenoid configured to operate the contact/separation mechanism. The solenoid is driven so that the contact/separation mechanism causes the pair of separable contact rollers to come into pressure contact with each other, and driving of the solenoid is cancelled so that the contact/separation mechanism causes the pair of separable contact rollers to be separated from each other. Pulse width modulation duty control is performed on the solenoid while the pair of separable contact rollers are in pressure contact with each other when a plurality of the sheets are conveyed one by one at an interval. An image forming apparatus according to the present invention includes the sheet conveyance device according to the present invention.

The present invention can exemplify an aspect in which the duty control may include fixed ON/OFF control of repeating first ON control of turning the solenoid ON for a predetermined fixed first ON time and first OFF control of turning the solenoid OFF for a predetermined fixed first OFF time in a pressure-contact period in which the pair of separable contact rollers are in a pressure-contact state.

The present invention can exemplify an aspect in which the first ON time may be longer than the first OFF time.

The present invention can exemplify an aspect in which the sheet conveyance device may further include a pair of conveyance rollers disposed at a position for cooperating with the pair of separable contact rollers to convey the sheet, the position being disposed more on an upstream side than the pair of separable contact rollers in a conveyance direction of the sheet, and in which the fixed ON/OFF control may include second ON control of turning the solenoid ON for a predetermined second ON time in a sheet conveyance period during which the pair of conveyance rollers convey the sheet.

The present invention can exemplify an aspect in which the second ON time may be longer than the first ON time.

The present invention can exemplify an aspect in which the sheet conveyance device may further include a document moving reading structure configured to read a document image while moving a document as the sheet, in which the document moving reading structure may include the pair of separable contact rollers disposed more on a downstream side than a reading position for the document in a conveyance direction of the document, and the pair of conveyance rollers disposed more on the downstream side than the reading position for the document and more on the upstream side than the pair of separable contact rollers in the conveyance direction, and in which the second ON control may be performed in a specific period in which an upstream side end of the document conveyed by the pair of conveyance rollers in the conveyance direction is positioned between the reading position for the document and a nip position of the pair of conveyance rollers, the specific period being a part of a document conveyance period during which the pair of conveyance rollers convey the document as the sheet.

The present invention can exemplify an aspect in which the pulse width modulation duty control may be performed in at least one of a separation-to-pressure-contact transition period in which the pair of separable contact rollers transition from a separated state to a pressure-contact state, and a pressure-contact-to-separation transition period in which the pair of separable contact rollers transition from the pressure-contact state to the separated state.

The present invention can exemplify an aspect in which gradually changed ON/OFF control of repeating third ON control of turning the solenoid ON for a predetermined third ON time that gradually changes and second OFF control of turning the solenoid OFF for a predetermined fixed second OFF time may be performed in at least one of the separation-to-pressure-contact transition period and the pressure-contact-to-separation transition period.

The present invention can exemplify an aspect in which the gradually changed ON/OFF control performed in the separation-to-pressure-contact transition period may be control of gradually increasing the third ON time.

The present invention can exemplify an aspect in which the control of gradually increasing the third ON time may be performed between a predetermined minimum start time shorter than the first ON time and a predetermined maximum end time longer than the first ON time.

The present invention can exemplify an aspect in which the gradually changed ON/OFF control performed in the pressure-contact-to-separation transition period may be control of gradually decreasing the third ON time.

The present invention can exemplify an aspect in which the control of gradually decreasing the third ON time may be performed between a predetermined maximum start time longer than the first ON time and a predetermined minimum end time shorter than the first ON time.

The present invention can exemplify an aspect in which the control of gradually decreasing the third ON time may include third OFF control of turning the solenoid OFF for a predetermined third OFF time immediately before the maximum start time.

The present invention can exemplify an aspect in which the third OFF time may be longer than the maximum start time.

The present invention can prevent the temperature rise of the solenoid that has been energized, and also can prevent the intermittent operating noise of the solenoid from being generated due to the solenoid driving operation and the solenoid driving cancel operation repeated, and thus can effectively overcome the disadvantage that the operating noise of the solenoid can make the user irritated.

DESCRIPTION OF THE EMBODIMENTS

Embodiments of the present invention are described with reference to the drawings.

[Image Forming Apparatus]

Figure 1:
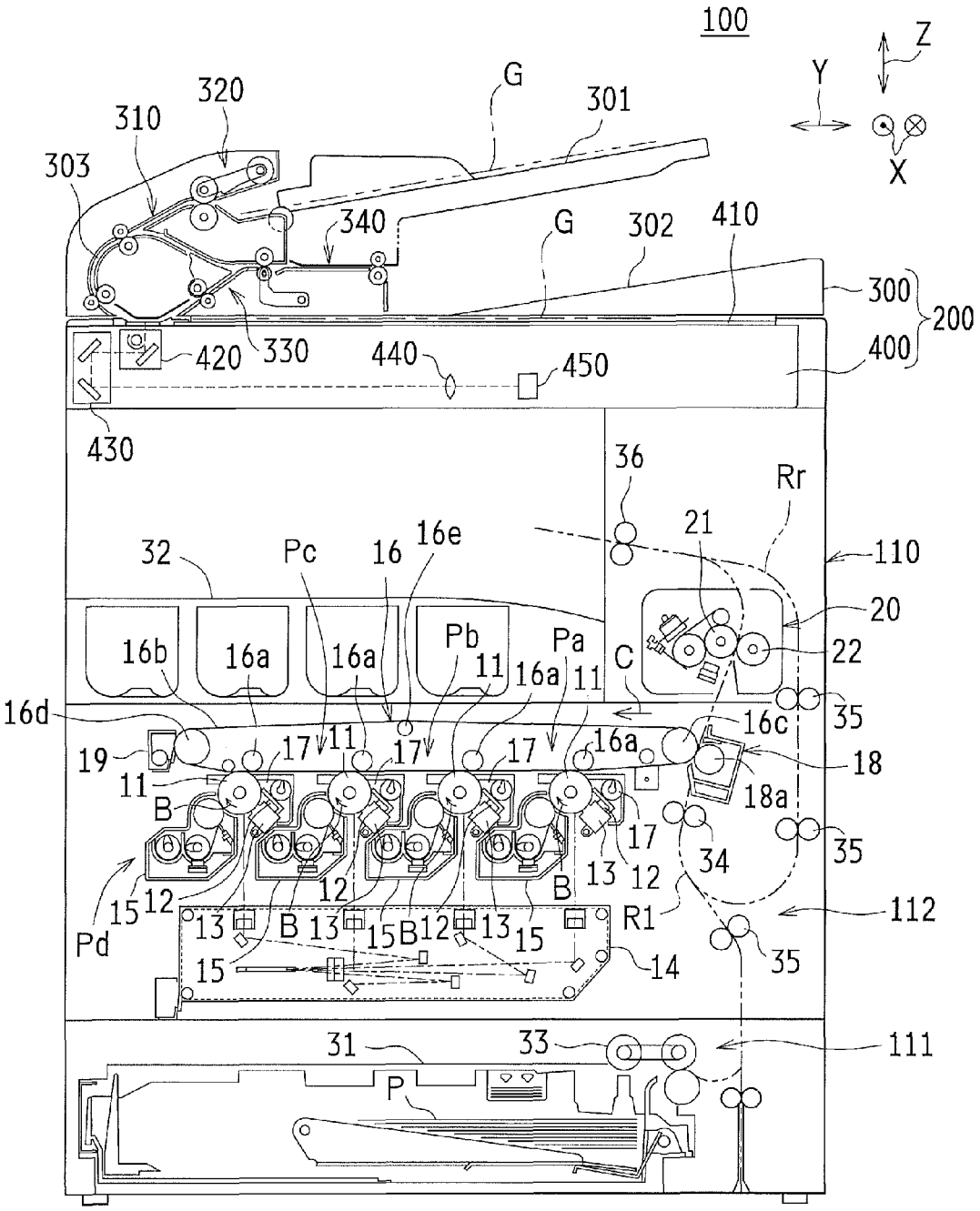
FIG. 1 is a schematic front view schematically illustrating a schematic configuration of an image forming apparatus according to an embodiment of the present invention.

FIG. 1 is a schematic front view schematically illustrating a schematic configuration of an image forming apparatus 100 according to an embodiment of the present invention.

As illustrated in FIG. 1, the image forming apparatus 100 includes an image reading device 200 and an image forming apparatus main body 110. The image forming apparatus main body 110 prints a monochrome image or a color image on a recording sheet P such as recording paper, based on image data read by the image reading device 200 or image data transmitted from an external device.

The image reading device 200 is placed on an upper surface of the image forming apparatus main body 110, and includes a document feeder 300 (an example of a sheet conveyance device) and a document reader 400. The image reading device 200 reads a document G (an example of a sheet) conveyed by the document feeder 300 or placed on a platen 410 with the document reader 400, and outputs image data representing an image of the document G thus read.

The image forming apparatus 100 is an electrophotographic image forming apparatus, and is what is known as a tandem color image forming apparatus in which a plurality of image carriers (more specifically, photosensitive bodies) are arranged side by side in a predetermined direction (a horizontal direction Y in this example). In this example, the image forming apparatus 100 is a color multifunction peripheral (MFP) that employs intermediate transferring and can form a full color image. The image forming apparatus 100, which is a tandem color image forming apparatus in the present embodiment, may be a color image forming apparatus of other types or may be a monochrome image forming apparatus.

The image forming apparatus main body 110 includes: photosensitive bodies 11 (more specifically, photosensitive drums); charge removers 12; charging units 13 serving as chargers; an exposing device 14; development devices 15; an intermediate transfer belt device 16 serving as a primary transfer device; drum cleaners 17; a secondary transfer device 18; a belt cleaner 19; a fixing device 20; a sheet conveyance path R1 (more specifically, a conveyance path of the recording sheet P); a paper feed tray 31; and a discharge tray 32.

In the image forming apparatus main body 110, the charging units 13 charge surfaces of the photosensitive bodies 11. The exposing device 14 exposes the charged areas to image exposure light so that electrostatic latent images are formed. The electrostatic latent images are visualized (developed) by the development devices 15 to be toner images. The toner images as a result of the visualization are electrostatically transferred onto the intermediate transfer belt device 16. The secondary transfer device 18 transfers the toner images transferred on the intermediate transfer belt device 16 onto the recording sheet P. Then, the fixing device 20 fixes the toner images that have been transferred onto the recording sheet P. In this manner, the image forming apparatus main body 110 serves as an image forming unit that forms an image on the recording sheet P.

A color image is formed with the toner images of respectively colors black (K), cyan (C), magenta (M), and yellow (Y) overlapped with each other. Thus, four image forming stations Pa, Pb, Pc, and Pd are formed with four photosensitive bodies 11, four charge removers 12, four charging units 13, four development devices 15 and four drum cleaners 17 provided for forming four types of toner images of the respective colors, and respectively correspond to black, cyan, magenta, and yellow.

The following operations are commonly performed in each of the image forming stations Pa, Pb, Pc, and Pd.

More specifically, the charge removers 12 to 12 irradiate the surfaces of the photosensitive bodies 11 to 11, drivingly rotated in a predetermined rotational direction B, with light to remove (charge removal) charges (remaining charges) on the surfaces of the photosensitive bodies 11 to 11.

The charging units 13 to 13 uniformly charge the surfaces of the photosensitive bodies 11 to 11, from which the charges have been removed by the charge removers 12 to 12, to a predetermined potential.

The exposing device 14 exposes the surfaces of the photosensitive bodies 11 to 11, which have been uniformly charged by the charging units 13 to 13, to light, whereby electrostatic latent images are formed on the surfaces of the photosensitive bodies 11 to 11.

The development devices 15 to 15 develop the electrostatic latent images on the surfaces of the photosensitive bodies 11 to 11, formed by the exposing device 14, whereby the toner images are formed on the surfaces of the photosensitive bodies 11 to 11.

In the image forming stations Pa, Pb, Pc, and Pd, the toner images of the respective colors are formed on the surfaces of the photosensitive bodies 11 to 11, through the series of operations described above.

The intermediate transfer belt device 16 includes primary transfer rollers 16*a*, an intermediate transfer belt 16*b*, a transfer drive roller 16*c*, a transfer driven roller 16*d*, and a tension roller 16*e*. Four primary transfer rollers 16*a* are provided on the inner side of the intermediate transfer belt 16*b* so that the four types of toner images corresponding to the respective colors are formed. The primary transfer rollers 16*a* to 16*a* transfer the toner images of the respective colors, formed on the surfaces of the photosensitive bodies 11 to 11, onto the intermediate transfer belt 16*b* rotating as indicated by an arrow C. The intermediate transfer belt 16*b* is wound across the transfer drive roller 16*c*, the transfer driven roller 16*d*, and the tension roller 16*e*.

The drum cleaners 17 to 17 remove and collect residual toner that was not transferred onto the intermediate transfer belt 16*b* and thus is remaining on the surfaces of the photosensitive bodies 11 to 11.

The secondary transfer device 18 includes a secondary transfer roller 18*a*. The secondary transfer roller 18*a* is disposed in such a manner that a nip area is formed between the secondary transfer roller 18*a* and the intermediate transfer belt 16*b*. The secondary transfer roller 18*a* conveys the recording sheet P, which has been conveyed thereto through the sheet conveyance path R1, while nipping the recording sheet P in the nip area, so that the toner image (for example, a color toner image) formed on the surface of the intermediate transfer belt 16*b* is transferred onto the recording sheet P passing through the nip area.

The belt cleaner 19 removes and collects residual toner that was not transferred onto the recording sheet P and thus is remaining on the surface of the intermediate transfer belt 16*b*.

The fixing device 20 includes a heating roller 21 and a pressure roller 22. The recording sheet P, on which the toner image has been transferred, is nipped between the heating roller 21 and the pressure roller 22 to be heated and pressed, whereby the toner image is fixed on the recording sheet P.

The recording sheets P are stacked on the paper feed tray 31. A pickup roller 33 is disposed on a side of the paper feed tray 31 from which the recording sheets P are supplied. The pickup roller 33 picks up the recording sheets P one by one from the paper feed tray 31, and conveys the recording sheet P to the sheet conveyance path R1.

The image forming apparatus main body 110 includes: a sheet feed device 111 that includes the pickup roller 33; and a sheet conveyance device 112 that conveys the recording sheet P that has been sent thereto by the sheet feed device 111.

The sheet conveyance device 112 includes registration rollers 34, conveyance rollers 35 to 35, discharge rollers 36, and a driving unit (not illustrated) that drives the rollers.

The sheet conveyance device 112 conveys the recording sheet P to the discharge rollers 36 on the sheet conveyance path R1, via the secondary transfer device 18 and the fixing device 20. The discharge rollers 36 are disposed on a side of the sheet conveyance path R1 from which the recording sheet P is discharged. The discharge rollers 36 discharge the recording sheet P conveyed thereto on the sheet conveyance path R1 onto the discharge tray 32. The registration rollers 34 and the conveyance rollers 35 to 35 are disposed on the sheet conveyance path R1. The registration rollers 34 temporarily stop the recording sheet P, register the leading edge of the recording sheet P, and then convey the recording sheet P in accordance with a transfer timing of the toner image at the nip area between the intermediate transfer belt 16*b* and the secondary transfer roller 18*a*. The conveyance rollers 35 to 35 facilitate the conveyance of the recording sheet P.

The sheet conveyance path R1 includes a reversing path Rr. In the image forming apparatus main body 110 the recording sheet P is conveyed backward to be conveyed to the reversing path Rr from the discharge roller 36, when the image forming is to be performed not only on a front surface of the recording sheet P but also on a back surface of the recording sheet P. Thus, the recording sheet P is reversed, and then is guided to the registration roller 34 again. Then, the toner image is fixed on the back surface of the recording sheet P in the same manner as that for the front surface of the recording sheet P. The resultant recording sheet P is discharged onto the discharge tray 32.

In FIG. 1 as well as FIGS. 2 to 9 and FIG. 14 that are described later, a sign X indicates a width direction (depth direction), a sign Y indicates a horizontal direction Y orthogonal to the width direction X, and a sign Z indicates a vertical direction (height direction). Components with reference numerals not described with reference to FIG. 1 will be described later.

[Overall Configuration of Image Reading Device]

Next, the document feeder 300 and the document reader 400 in the image reading device 200 illustrated in FIG. 1 are described.

Figure 2:
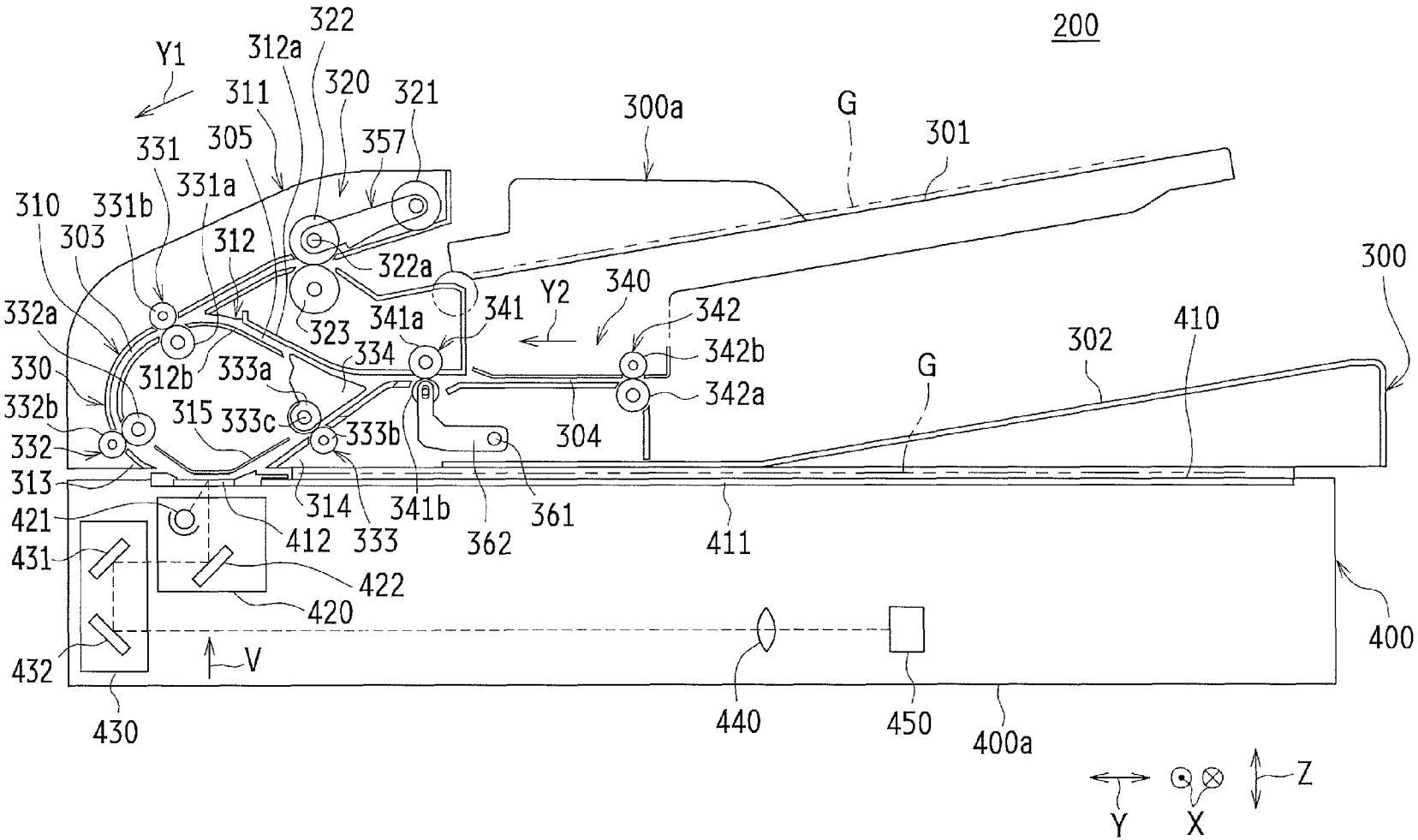
FIG. 2 is a schematic front view schematically illustrating schematic configurations of a document feeder and a document reader in an image reading device illustrated in FIG. 1.

FIG. 2 is a schematic front view schematically illustrating schematic configurations of the document feeder 300 and the document reader 400 in the image reading device 200 illustrated in FIG. 1.

The image reading device 200 is an optical reduction image reading device. The image reading device 200 has: a fixed document reading structure for reading a document image from the document G placed on the platen 410, based on a stationary document system; and a document moving reading structure for reading the document image from the document G being moved, based on a moving document system.

In the fixed document reading structure, the document G placed on a glass platen 411 as a component of the platen 410 is irradiated with light from a light source unit 420 serving as an illumination device, via the glass platen 411. The document image is read with the reflected light from the document G, irradiated with light from the light source unit 420, scanned in a primary scanning direction (width direction X) orthogonal to a secondary scanning direction, while the light source unit 420 is being moved to a one side in the secondary scanning direction (horizontal direction Y).

In the document moving reading structure, the document G is conveyed in a predetermined conveyance direction Y1 by the document feeder 300 in such a manner as to move over a document reading glass member 412 as a component of the platen 410. In this process, the document G is irradiated with light from the light source unit 420, positioned at a fixed position V in the document reader 400, via the document reading glass member 412. The document image is read with the reflected light from the document G, irradiated with light from the light source unit 420, scanned in the primary scanning direction (width direction X).

More specifically, the document reader 400, including the glass platen 411, the document reading glass member 412, and the light source unit 420, further includes: an optical system driving unit (not illustrated) that moves the light source unit 420; a mirror unit 430; a condenser lens 440; and a photoelectric conversion element (a charge couple device (CCD) in this example) 450. These components are incorporated in a frame body 400*a*. The light source unit 420 includes: a light source 421 that emits the light onto the document G; and a first mirror 422 that guides the reflected light, from the document G, to the mirror unit 430.

The glass platen 411 and the document reading glass member 412 are each formed of a transparent glass plate having both end portions in the primary scanning direction (width direction X) placed on the frame body 400*a*. The document feeder 300 is openable/closable about an axis along the secondary scanning direction (horizontal direction Y) relative to the document reader 400 at the other end side (more specifically, a back surface side) in the width direction X (more specifically, pivotally supported by a hinge (not illustrated)). The document feeder 300 has a lower surface serving as a document presser member that presses the document G placed on the glass platen 411 of the document reader 400 from above. Thus, in the image reading device 200, the document G can be placed on the glass platen 411 of the document reader 400 exposed as a result of opening the document feeder 300.

The mirror unit 430 includes a second mirror 431, a third mirror 432, and a supporting member (not illustrated). The supporting member of the mirror unit 430 supports the second mirror 431 in such a manner that the light from the first mirror 422 in the light source unit 420 is reflected to be guided to the third mirror 432, and supports the third mirror 432 in such a manner that light from the second mirror 431 is reflected to be guided to the condenser lens 440. With the condenser lens 440, the light from the third mirror 432 in the mirror unit 430 is concentrated on an acceptance surface 451 of the photoelectric conversion element 450. The photoelectric conversion element 450 converts light (document image light) from the condenser lens 440 into an electric signal representing image data.

The optical system driving unit in the document reader 400 moves the light source unit 420 at constant speed in the secondary scanning direction (horizontal direction Y), and also moves the mirror unit 430 at half the speed of the movement speed of the light source unit 420 in the secondary scanning direction (horizontal direction Y).

The document feeder 300 includes: a document tray 301 on which one or a plurality of documents G to be conveyed are placed; a discharge tray 302 disposed below the document tray 301; a sheet conveyance path 303 and a sheet discharge conveyance path 304 connecting between the document tray 301 and the discharge tray 302; a sheet feed device 320 including a pickup roller 321; a sheet conveyance device 330 that conveys the document G transmitted thereto from the sheet feed device 320; and a sheet discharge apparatus 340 that discharges the document G transmitted thereto from the sheet conveyance device 330, onto the discharge tray 302. The document tray 301 serves as a sheet placed portion on which one or a plurality of documents G are placed. The sheet conveyance path 303 includes a sheet conveyance guide unit 310. The pickup roller 321, which can be hoisted and lowered, is lowered from the hoisted position to send one or a plurality of documents G placed on the document tray 301 one by one.

(Sheet Conveyance Guide Unit)

The sheet conveyance guide unit 310 guides the document G being conveyed. The sheet conveyance guide unit 310 includes a first conveyance guide member 311 and a second conveyance guide member 312. The first conveyance guide member 311 is openable/closable with respect to a document feeder main body 300*a* to facilitate a work of removing the document when the document G is jammed (JAM), and a maintenance work including cleaning of the components. The first conveyance guide member 311 is provided with the pickup roller 321. The first conveyance guide member 311 forms the sheet conveyance path 303 (more specifically, the conveyance path for the document G), while being closed with respect to the document feeder main body 300*a*.

The second conveyance guide member 312 is provided to the document feeder main body 300*a*. The second conveyance guide member 312 is covered by the first conveyance guide member 311 in such a manner that the sheet conveyance path 303, through which the document G passes, is formed between the second conveyance guide member 312 and the first conveyance guide member 311, when the first conveyance guide member 311 is closed.

(Sheet Feed Device)

The sheet feed device 320 supplies the document G from the document tray 301 one by one to the sheet conveyance path 303.

More specifically, the sheet feed device 320, including the pickup roller 321, further includes a sheet feed roller 322 and a separation member such as a separation roller and a separation pad (a separation roller 323 in this example).

The pickup roller 321 sends the document G, placed on the document tray 301, to the sheet feed roller 322 and the separation roller 323 from the document tray 301 along the conveyance direction Y1. The sheet feed roller 322 is disposed more on the downstream side than the pickup roller 321 in the conveyance direction Y1. The document G transmitted from the pickup roller 321 is conveyed toward the downstream side in the conveyance direction Y1 while being nipped by the sheet feed roller 322 and the separation roller 323.

The separation roller 323 faces the sheet feed roller 322 and separates the documents G conveyed while being nipped between the separation roller 323 and the sheet feed roller 322 into individual sheets.

The pickup roller 321 and the sheet feed roller 322 are provided to the first conveyance guide member 311, and the separation roller 323 is provided to the second conveyance guide member 312. Thus, when the first conveyance guide member 311 is closed so that the sheet conveyance path 303 is formed by the first conveyance guide member 311 and the second conveyance guide member 312, the pickup roller 321 is positioned above the document tray 301, and the sheet feed roller 322 and the separation roller 323 are in pressure contact with each other.

(Sheet Conveyance Device)

The sheet conveyance device 330 conveys the document G, supplied thereto from the sheet feed device 320, to the discharge tray 302.

More specifically, the sheet conveyance device 330 includes: a pair of registration rollers 331 (331*a* and 331*b*); a pair of upstream side conveyance rollers 332 (332*a* and 332*b*); and a pair of downstream side conveyance rollers 333 (333*a* and 333*b*) (an example of a pair of conveyance rollers).

The pair of registration rollers 331 are configured to temporarily stop the document G conveyed from the sheet feed device 320 while being guided by the sheet conveyance path 303, and then resume the conveyance of the document G at a predetermined timing.

The pair of registration rollers 331 have the driving side registration roller 331*a* provided to the second conveyance guide member 312 of the document feeder main body 300*a*, and have the driven side registration roller 331*b* provided to the first conveyance guide member 311. The driving side registration roller 331*a* and the driven side registration roller 331*b* are in pressure contact with each other to form the pair of registration rollers 331, in a state where the sheet conveyance path 303 is formed by the first conveyance guide member 311 and the second conveyance guide member 312.

The pair of upstream side conveyance rollers 332 are disposed more on the downstream side than the pair of registration rollers 331, and are disposed more on the upstream side than the document reading glass member 412, in the conveyance direction Y1 of the document G. The pair of conveyance rollers 332 convey the document G at a portion more on the upstream side than the document reading glass member 412. The pair of downstream side conveyance rollers 333 are disposed more on the upstream side than a pair of separable contact rollers 341 described later and are disposed more on the downstream side than the document reading glass member 412 in the conveyance direction Y1, and convey the document G at a portion more on the downstream side than the document reading glass member 412. More specifically, the pair of upstream side conveyance rollers 332, the document reading glass member 412, and the pair of downstream side conveyance rollers 333 are arranged in this order in the sheet conveyance path 303. The document reading glass member 412 is arranged substantially horizontally to form a part of a guide wall of the sheet conveyance path 303.

In this example, the document feeder 300 conveys the document G so that its one surface (front surface) can be read. Then, the document feeder 300 reverses the document G and conveys the document G so that its other surface (back surface) can be read.

Thus, the sheet conveyance guide unit 310 has a configuration of reversing the document G.

The document G sent from the sheet feed device 320 is reversed while passing through the sheet conveyance path 303. The sheet conveyance path 303 has a loop form in which the document G is conveyed from the sheet feed roller 322 to the sheet discharge apparatus 340 via the pair of registration rollers 331, the pair of upstream side conveyance rollers 332, the document reading glass member 412, and the pair of downstream side conveyance rollers 333.

The sheet conveyance guide unit 310 further includes an upstream side guide 313, a downstream side guide 314, and a document reading guide 315 provided to the document feeder main body 300*a*. The document reading guide 315 guides the document G conveyed through the upstream side guide 313, the downstream side guide 314, and the document reading glass member 412. The upstream side guide 313 and the downstream side guide 314 each cooperate with the document reading guide 315 to guide the document G conveyed by a corresponding one of the pair of upstream side conveyance rollers 332 and the pair of downstream side conveyance rollers 333.

More specifically, the upstream side guide 313 is disposed on the upstream side of the document reading glass member 412 in the conveyance direction Y1. The downstream side guide 314 is disposed on the downstream side of the document reading glass member 412 in the conveyance direction Y1. The document reading guide 315 is disposed to face each of the upstream side guide 313, the downstream side guide 314, and the document reading glass member 412, while being apart from these members by predetermined distances. The sheet conveyance path 303 is formed between the document reading guide 315 and each of the upstream side guide 313, the document reading glass member 412, and the downstream side guide 314.

(Sheet Discharge Apparatus)

The sheet discharge apparatus 340 discharges the document G, from the sheet conveyance path 303, to the outside.

In the present embodiment, the image reading device 200 reads both surfaces of the document G.

The sheet discharge apparatus 340 further has a function of pulling back the document G that is being discharged from the sheet conveyance path 303.

More specifically, the sheet discharge apparatus 340 includes the pair of separable contact rollers 341 (341*a* and 341*b*) (a pair of reversing rollers in this example) and a pair of discharge rollers 342 (342*a* and 342*b*).

The pair of separable contact rollers 341 are disposed more on the downstream side than the pair of downstream side conveyance rollers 333 in the conveyance direction Y1, that is, between the pair of downstream side conveyance rollers 333 and the pair of discharge rollers 342. The pair of separable contact rollers 341 convey the document G, conveyed thereto from the pair of downstream side conveyance rollers 333, to the pair of discharge rollers 342. Furthermore, the pair of separable contact rollers 341 convey the document G, conveyed thereto from the pair of downstream side conveyance rollers 333, in a reverse conveyance direction Y2 opposite to the conveyance direction Y1, so that the document G is conveyed with its end that is used to be the trailing edge (an upstream side end in the conveyance direction Y1) now facing forward. Then, the pair of downstream side conveyance rollers 333 are disposed at a position for cooperating with the pair of separable contact rollers 341 to convey the document G. The position is immediately on the upstream side of the pair of separable contact rollers 341 in the conveyance direction Y1 of the document G.

The pair of discharge rollers 342 are disposed more on the downstream side than the pair of separable contact rollers 341 in the conveyance direction Y1, that is, between the pair of separable contact rollers 341 and the discharge tray 302. The pair of discharge rollers 342 discharges the document G, conveyed thereto from the pair of separable contact rollers 341, to the discharge tray 302. Furthermore, the pair of discharge rollers 342 convey the document G in the reverse conveyance direction Y2 so that the document G, conveyed thereto from the pair of separable contact rollers 341, is conveyed with its end that is used to be the trailing edge now facing forward.

The sheet discharge conveyance path 304 is disposed between the sheet conveyance path 303 and the pair of discharge rollers 342.

The document feeder 300 further includes a switchback conveyance path 305 that is formed between two guide members 312*a* and 312*b* of the second conveyance guide member 312. The document G pulled back by the sheet discharge apparatus 340 passes through the switchback conveyance path 305.

In this example, the sheet conveyance device 330 further includes a branch member 334 disposed between an outlet side of the sheet conveyance path 303 and an inlet side of the switchback conveyance path 305.

The sheet discharge conveyance path 304 serves as a forward conveyance path for the document G conveyed by the normal rotation of the pair of separable contact rollers 341 and the pair of discharge rollers 342, and also serves as a reverse conveyance path for the document G conveyed by the reverse rotation of the pair of separable contact rollers 341 and the pair of discharge rollers 342.

In the switchback conveyance path 305, the document G that has been conveyed by the pair of discharge rollers 342 with its end that is used to be the trailing edge facing forward, and then guided to the switchback conveyance path 305 at the branch member 334 is guided toward the upstream side of the pair of registration rollers 331 of the sheet conveyance path 303 in the conveyance direction Y1. Thus, the image reading device 200 can read both surfaces of the document G.

The branch member 334 can pivot about a pivot axis along the width direction X of the document G orthogonal to or approximately orthogonal to the conveyance direction Y1 of the document G.

More specifically, the branch member 334 can pivot about a rotating shaft 333*c* along the width direction X, and has an approximately triangular shape in front view. The branch member 334 may be detachably attached to a rotating shaft 330*a*, in such a manner as to be capable of pivoting about the rotating shaft 330*a*.

Components with reference numerals not described with reference to FIG. 2 will be described later.

[Partial Internal Configuration of Document Feeder]

Next, a partial internal configuration of the document feeder 300 is described below with reference to FIGS. 3 and 4.

Figure 3:
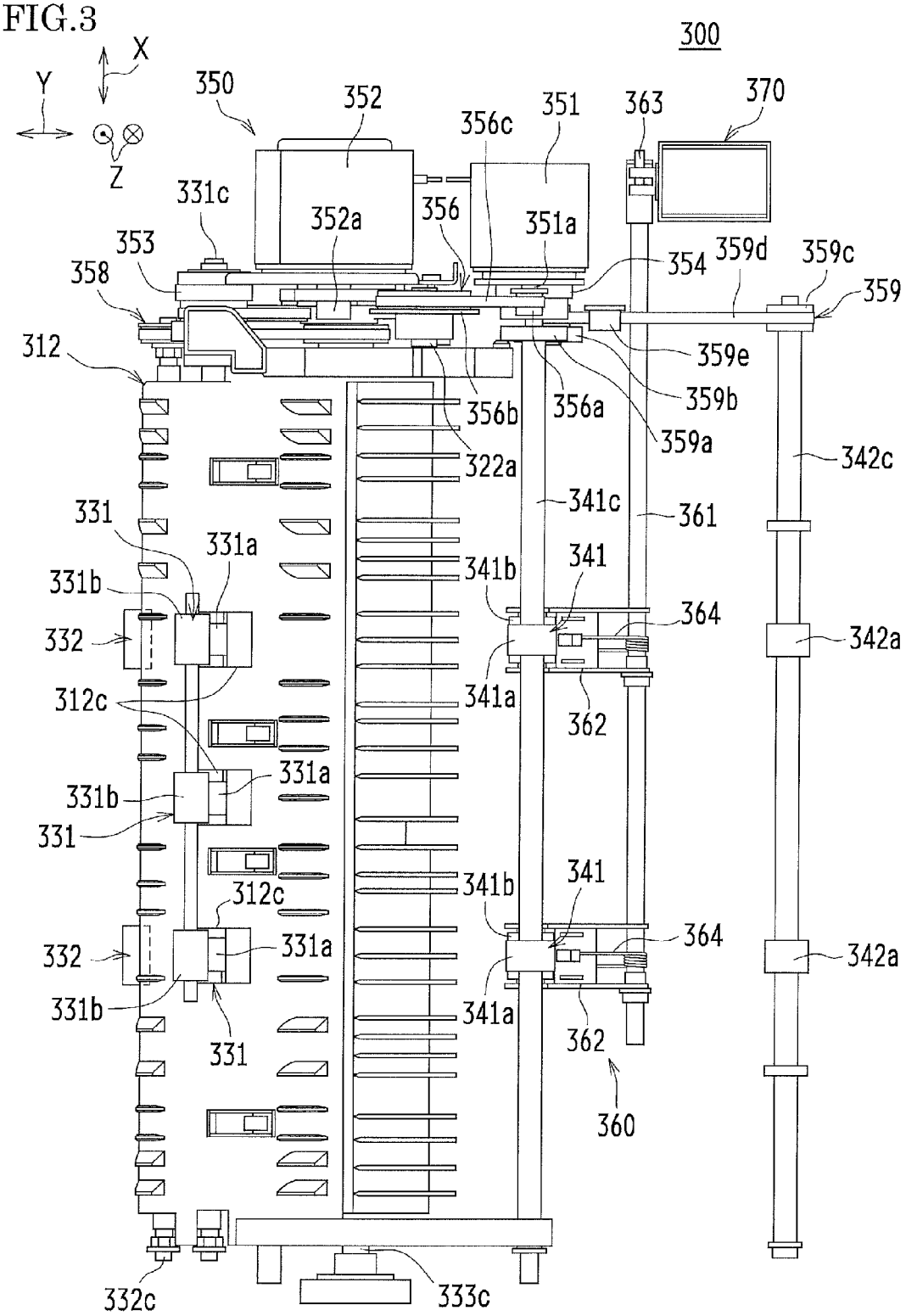
FIG. 3 is a schematic plan view illustrating a partial internal configuration of the document feeder as viewed from above.

FIG. 3 is a schematic plan view illustrating the partial internal configuration of the document feeder 300 as viewed from above. FIG. 4 is a schematic perspective view illustrating the partial internal configuration of the document feeder 300 as viewed from a diagonally upper side. FIGS. 3 and 4 illustrate states where a cover member, the first conveyance guide member 311, and the like are removed from the document feeder 300. In the figures, a portion of a rotating shaft 322*a* of the sheet feed roller 322 on a side of the sheet feed roller 322 and the driven side discharge roller 342*b* as one of the pair of discharge rollers 342 are omitted from the drawings. In the states illustrated in FIGS. 3 and 4, the driven side separable contact roller 341*b* is in pressure contact with the driving side separable contact roller 341*a*.

Figure 4:
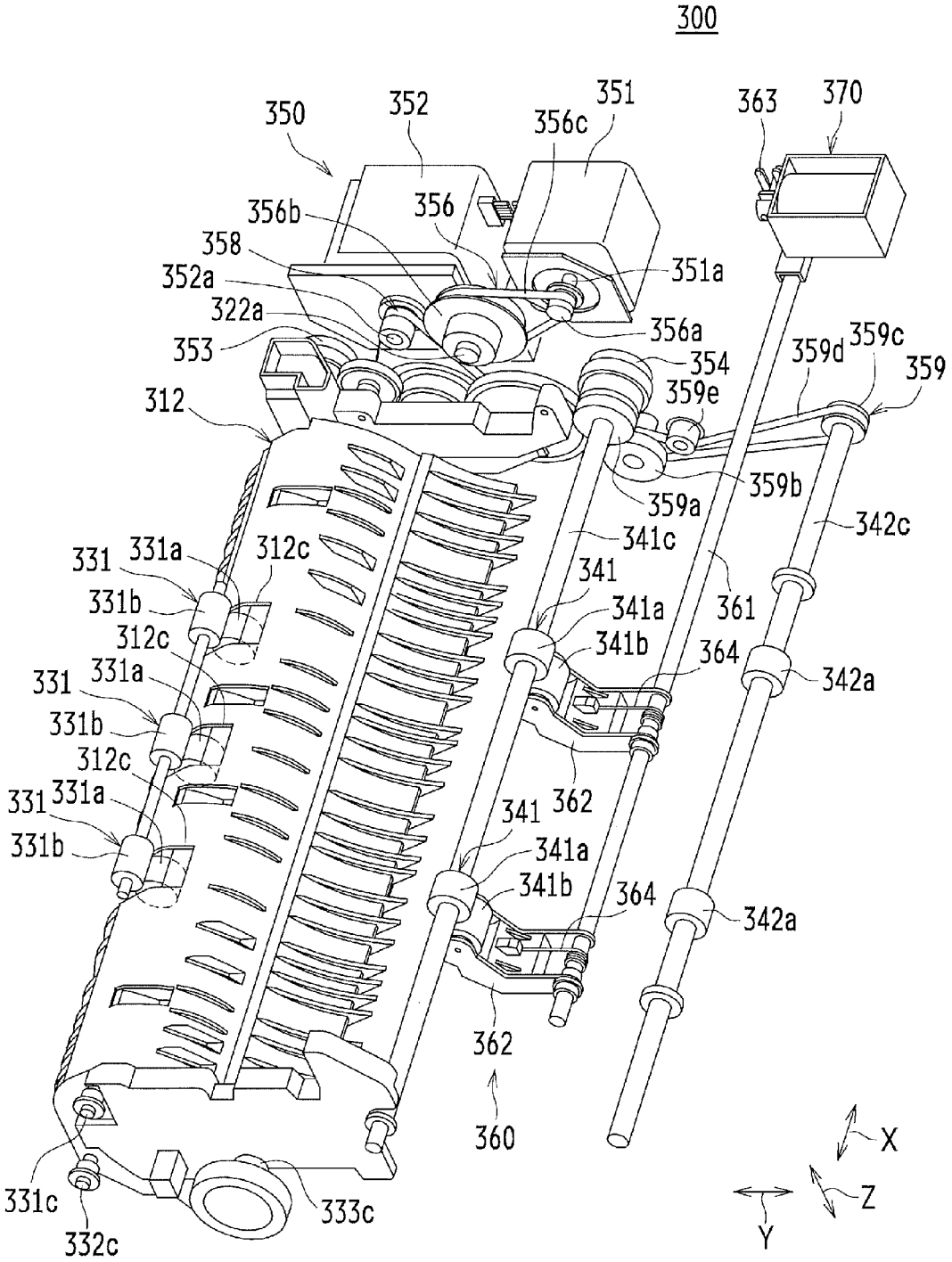
FIG. 4 is a schematic perspective view illustrating a partial internal configuration of the document feeder as viewed from a diagonally upper side.

As illustrated in FIGS. 3 and 4, a plurality of (three in this example) driving side registration rollers 331*a* to 331*a*, each being one of the pair of registration rollers 331, are disposed on the inner side of the second conveyance guide member 312. The driving side registration rollers 331*a* to 331*a* each partially protrude from a corresponding one of opening sections 312*c* to 312*c* provided to the second conveyance guide member 312. The opening sections 312*c* to 312*c* are formed on the second conveyance guide member 312 in such a manner as to respectively correspond to the driving side registration rollers 331*a* to 331*a*. The first conveyance guide member 311 (not illustrated in FIG. 3 and FIG. 4, see FIG. 2) is provided with a plurality of (three in this example) driven side registration rollers 331*b* to 331*b*, each being one of the pair of registration rollers 331. The driven side registration rollers 331*b* to 331*b* are respectively in pressure contact with the driving side registration rollers 331*a* to 331*a*.

A plurality of (two in this example) sets of driving side conveyance rollers (332*a* and 332*a*) and (333*a* and 333*a*) (not illustrated in FIG. 3 and FIG. 4, see FIG. 2), respectively forming the pairs of conveyance rollers 332 and 333, are disposed on the inner side of the second conveyance guide member 312. The driving side conveyance rollers (332*a* and 332*a*) and (333*a* and 333*a*) each partially protrude from a corresponding one of opening sections (not illustrated) formed in the second conveyance guide member 312. The opening sections are formed in the second conveyance guide member 312 in such a manner as to respectively correspond to the driving side conveyance rollers (332*a* and 332*a*) and (333*a* and 333*a*). A plurality of (two in this example) sets of driven side conveyance rollers (332*b* and 332*b*) and (333*b* and 333*b*) are respectively provided to the upstream side guide 313 and the downstream side guide 314 (not illustrated in FIG. 3 and FIG. 4, see FIG. 2). The driven side conveyance rollers (332*b* and 332*b*) and (333*b* and 333*b*) are respectively in pressure contact with the driving side conveyance rollers (332*a* and 332*a*) and (333*a* and 333*a*).

The pair of separable contact rollers 341 are disposed more on the downstream side than the pair of downstream side conveyance rollers 333 in the conveyance direction Y1. The pair of separable contact rollers 341 include a plurality of (two in this example) driving side separable contact rollers 341*a* and a plurality of (two in this example) driven side separable contact rollers 341*b*.

The pair of discharge rollers 342 are disposed more on the downstream side than the pair of separable contact rollers 341 in the conveyance direction Y1 (see FIG. 2). The pair of discharge rollers 342 include a plurality of (two in this example) driving side discharge rollers 342*a* and a plurality of (two in this example) driven side discharge rollers 342*b* (not illustrated in FIG. 3 and FIG. 4, see FIG. 2).

(Drive System)

The document feeder 300 includes a drive system 350 that drives a conveyance system for conveying the document G.

The drive system 350 is provided on the other side (more specifically, on the back surface side) in the width direction X on the second conveyance guide member 312.

The drive system 350 includes a feed motor 351, a conveyance motor 352, a registration roller electromagnetic clutch 353, a separable contact roller electromagnetic clutch 354, a contact/separation mechanism 360, and a solenoid 370.

The feed motor 351 drivingly rotates the pickup roller 321 (not illustrated in FIG. 3 and FIG. 4, see FIG. 2) and the sheet feed roller 322 (not illustrated in FIG. 3 and FIG. 4, see FIG. 2).

The drive system 350 further includes a drive transmission mechanism 356 that transmits rotational driving force from an output shaft 351*a* of the feed motor 351 to the sheet feed roller 322. The drive transmission mechanism 356 includes a driving side pulley 356*a*, a driven side pulley 356*b*, and an endless belt 356*c*.

The driving side pulley 356*a* is fixed to the output shaft 351*a* of the feed motor 351. The driven side pulley 356*b* is fixed to the rotating shaft 322*a* of the sheet feed roller 322. The rotating shaft 322*a* is rotatably supported by a main body frame (not illustrated) of the document feeder main body 300*a*. The endless belt 356*c* is wound across the driving side pulley 356*a* and the driven side pulley 356*b*. Thus, the drive transmission mechanism 356 transmits the rotational driving force from the output shaft 351*a* of the feed motor 351 to the rotating shaft 322*a* of the sheet feed roller 322, via the driving side pulley 356*a*, the driven side pulley 356*b*, and the endless belt 356*c*, so that the sheet feed roller 322 can be rotated.

The drive system 350 further includes a drive transmission mechanism 357 (not illustrated in FIG. 3 and FIG. 4, see FIG. 2) that transmits the rotational driving force from the rotating shaft 322*a* of the sheet feed roller 322 to the pickup roller 321. The drive transmission mechanism 357 includes a pulley (not illustrated) and an endless belt (not illustrated).

The pickup roller 321 is rotated with the rotational driving force from the sheet feed roller 322 transmitted thereto via the drive transmission mechanism 357.

The pickup roller 321 is supported in such a manner as to rotate about the rotating shaft 322*a* of the sheet feed roller 322. Thus, when the sheet feed roller 322 and the pickup roller 321 are drivingly rotated, the pickup roller 321 rotate about the rotating shaft 322*a* of the sheet feed roller 322 to be pressed against the document G on the document tray 301, whereby the documents can be picked up one by one.

The conveyance motor 352 drivingly rotates the pair of registration rollers 331, the pair of upstream side conveyance rollers 332, the pair of downstream side conveyance rollers 333, the pair of separable contact rollers 341, and the pair of discharge rollers 342.

The drive system 350 further includes a drive transmission mechanism 358 that transmits the rotational driving force from an output shaft 352*a* of the conveyance motor 352 to the driving side registration roller 331*a*, the driving side conveyance roller 332*a* and 333*a*, and the driving side separable contact roller 341*a*. The drive transmission mechanism 358 includes a plurality of pulleys (some of which are not illustrated) and a plurality of endless belts (some of which are not illustrated).

The driving side registration roller 331*a*, the driving side conveyance rollers 332*a* and 333*a*, and the driving side separable contact roller 341*a* are rotated with the rotational driving force from the output shaft 352*a* of the conveyance motor 352 transmitted to a rotating shaft 331*c* of the driving side registration roller 331*a*, a rotating shaft 332*c* of the driving side conveyance roller 332*a*, the rotating shaft 333*c* of the driving side conveyance roller 333*a*, and a rotating shaft 341*c* of the driving side separable contact roller 341*a*, via the drive transmission mechanism 358.

The pair of registration rollers 331 are constantly in pressure contact with each other. When the driving side registration roller 331*a* is drivingly rotated, the driven side registration roller 331*b* is driven to be rotated. The pair of upstream side conveyance rollers 332, the pair of downstream side conveyance rollers 333, and the pair of discharge rollers 342 are also constantly in pressure contact with each other. Thus, when the driving side conveyance rollers 332*a* and 333*a* and the driving side discharge roller 342*a* are drivingly rotated, the driven side conveyance rollers 332*b* and 333*b* and the driven side discharge roller 342*b* are driven to be rotated.

The contact/separation mechanism 360 and the solenoid 370 cause the pair of separable contact rollers 341 to be in pressure contact with or separated from each other. When the pair of separable contact rollers 341 are in pressure contact with each other, the driven side separable contact roller 341*b* is driven to be rotated by the driving side separable contact roller 341*a* that is drivingly rotated.

The drive system 350 further includes a drive transmission mechanism 359 that transmits the rotational driving force from the rotating shaft 341*c* of the driving side separable contact roller 341*a* to a rotating shaft 342*c* of the driving side discharge roller 342*a*. The drive transmission mechanism 359 includes a gear 359*a*, a gear pulley 359*b*, a pulley 359*c*, an endless belt 359*d*, and a tension roller 359*e*. The gear 359*a* is fixed to the rotating shaft 341*c* of the driving side separable contact roller 341*a*. The gear pulley 359*b* meshes with the gear 359*a*. The pulley 359*c* is fixed to the rotating shaft 342*c* of the driving side discharge roller 342*a*. The endless belt 359*d* is wound across the gear pulley 359*b* and the pulley 359*c*. The tension roller 359*e* applies tension to the endless belt 359*d* wound across the gear pulley 359*b* and the pulley 359*c*.

The driving side discharge roller 342*a* is rotated when the rotational driving force from the rotating shaft 341*c* of the driving side separable contact roller 341*a* is transmitted to the rotating shaft 342*c* of the driving side discharge roller 342*a* via the drive transmission mechanism 359. The rotating shafts 341*c* and 342*c* are rotatably supported by the main body frame (not illustrated) of the document feeder main body 300*a*.

The registration roller electromagnetic clutch 353 couples between the rotating shaft 331*c* of the driving side registration roller 331*a* and the output shaft 352*a* of the conveyance motor 352, via the drive transmission mechanism 358. The registration roller electromagnetic clutch 353 is switched between a driving force transmission state and a driving force shutoff state, based on an instruction signal from a control unit 120 described later (see FIG. 10). In the driving force transmission state, the rotational driving force is transmitted from the output shaft 352*a* of the conveyance motor 352 to the rotating shaft 331*c* of the driving side registration roller 331*a*. In the driving force shutoff state, the rotational driving force from the output shaft 352*a* of the conveyance motor 352 to the rotating shaft 331*c* of the driving side registration roller 331*a* is shutoff. Thus, under the instruction from the control unit 120, the registration roller electromagnetic clutch 353 rotates the driving side registration roller 331*a* with the rotational driving force from the output shaft 352*a* of the conveyance motor 352 while being in the driving force transmission state, and stops the rotation of the driving side registration roller 331*a* while being in the driving force shutoff state.

The separable contact roller electromagnetic clutch 354 couples between the rotating shaft 341*c* of the driving side separable contact roller 341*a* and the output shaft 352*a* of the conveyance motor 352, via the drive transmission mechanism 358. The separable contact roller electromagnetic clutch 354 is switched between the driving force transmission state and the driving force shutoff state, based on an instruction signal from the control unit 120. In the driving force transmission state, the rotational driving force is transmitted from the output shaft 352*a* of the conveyance motor 352 to the rotating shaft 341*c* of the driving side separable contact roller 341*a*. In the driving force shutoff state, the rotational driving force from the output shaft 352*a* of the conveyance motor 352 to the rotating shaft 341*c* of the driving side separable contact roller 341*a* is shutoff. Thus, under the instruction from the control unit 120, the separable contact roller electromagnetic clutch 354 rotates the rotating shaft 341*c* of the driving side separable contact roller 341*a* with the rotational driving force from the output shaft 352*a* of the conveyance motor 352 while being in the driving force transmission state, and stops the rotation of the driving side separable contact roller 341*a* while being in the driving force shutoff state.

(Contact/Separation Mechanism)

The contact/separation mechanism 360 supports the pair of separable contact rollers 341 in such a manner that the pair of separable contact rollers 341 are able to come into separable contact with each other. The contact/separation mechanism 360 moves at least one of the driving side separable contact roller 341*a* and the driven side separable contact roller 341*b* to be in contact with and be separated from the counterpart (in this example, the driven side separable contact roller 341*b* is moved with respect to the driving side separable contact roller 341*a*).

The contact/separation mechanism 360 makes the driven side separable contact roller 341*b* swing about the axis along the width direction X in such a manner as to be capable of being in contact with and separated from the driving side separable contact roller 341*a*.

The contact/separation mechanism 360 includes: a rotation shaft 361 that is in parallel with or approximately in parallel with the rotating shaft 341*c* of the driving side separable contact roller 341*a*; first swing members 362 that are provided to the rotation shaft 361 and rotatably support the driving side separable contact rollers 341*a*; and a second swing member 363 that is provided to the rotation shaft 361 and operated by the solenoid 370 to make the rotation shaft 361 pivot about the axis.

Components with reference numerals not described with reference to FIGS. 3 and 4 will be described later.

Figure 5:
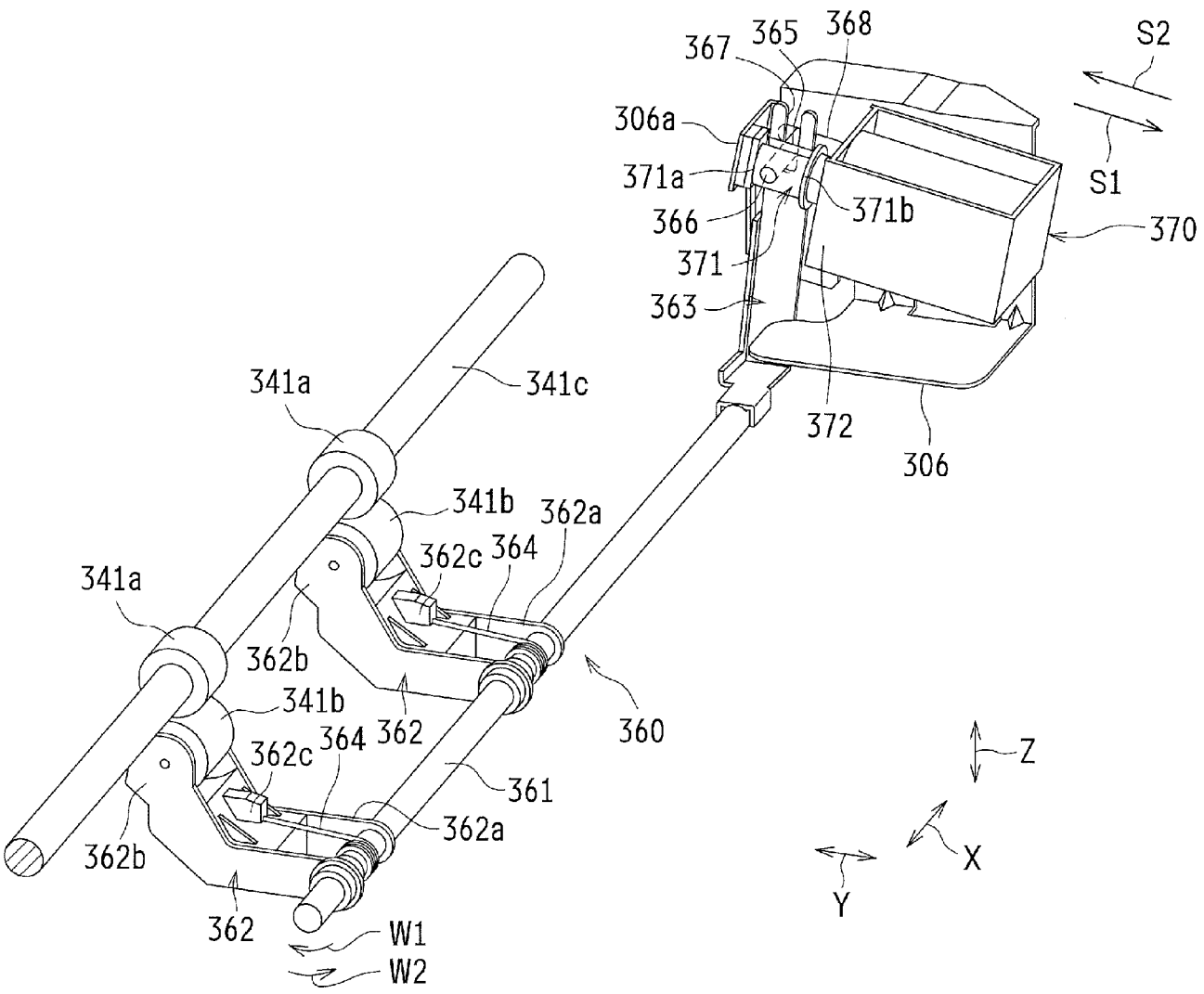
FIG. 5 is a schematic perspective view of a contact/separation mechanism, illustrated in FIGS. 3 and 4, as viewed from a diagonally upper side, and illustrates a pair of separable contact rollers in a pressure-contact state.
Figure 6:
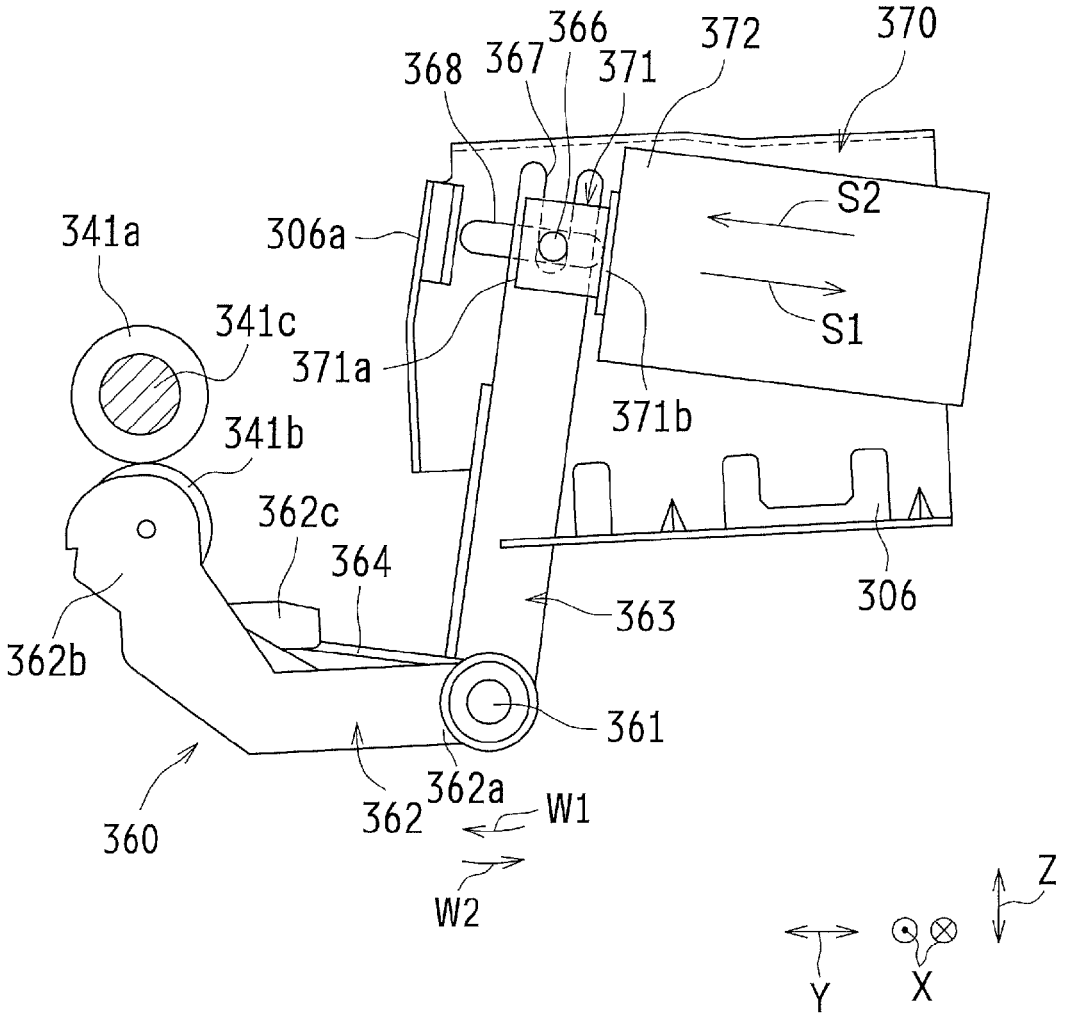
FIG. 6 is a schematic side view of the contact/separation mechanism illustrated in FIGS. 3 and 4, illustrates the pair of separable contact rollers in the pressure-contact state.
Figure 7:
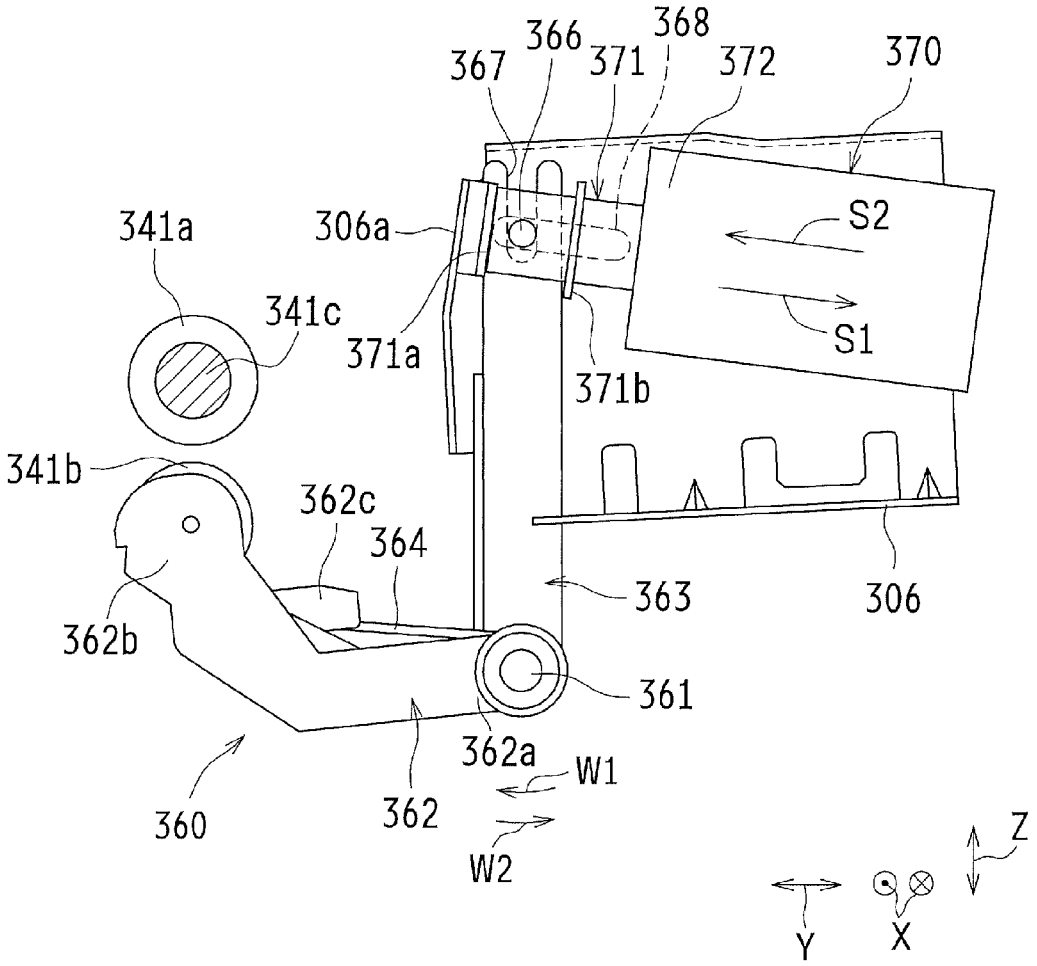
FIG. 7 is a schematic side view of the contact/separation mechanism illustrated in FIGS. 3 and 4, illustrates the pair of separable contact rollers in a separated state.

FIG. 5 is a schematic perspective view illustrating the contact/separation mechanism 360, illustrated in FIGS. 3 and 4, as viewed from a diagonally upper side. FIGS. 6 and 7 are schematic side views of the contact/separation mechanism 360 illustrated in FIGS. 3 and 4. FIGS. 5 and 6 illustrate the pair of separable contact rollers 341 in the pressure-contact state. FIG. 7 illustrates the pair of separable contact rollers 341 in the separated state.

In the contact/separation mechanism 360, the rotation shaft 361 is disposed on a side in which the driven side separable contact roller 341*b* is separated from the driving side separable contact roller 341*a*. The rotation shaft 361 is rotatably supported by the main body frame (not illustrated) of the document feeder main body 300*a*.

The first swing member 362 brings the driven side separable contact roller 341*b* into elastic pressure contact with the driving side separable contact roller 341*a*.

In this example, the contact/separation mechanism 360 further includes restoring force delivery units 364 that each couple between the rotation shaft 361 and the first swing member 362.

The first swing members 362 are rotatably supported at positions of the rotation shaft 361 corresponding to the pair of separable contact rollers 341. The first swing member 362 has a base end portion 362*a* rotatably supported by the rotation shaft 361, and has a distal end portion 362*b* rotatably supporting the driven side separable contact roller 341*b*. The first swing member 362 swung in a pressure-contact direction W1 toward the driving side separable contact roller 341*a* (clockwise direction in FIGS. 5 to 7) brings the driven side separable contact rollers 341*b* into contact with driving side separable contact rollers 341*a*. The first swing member 362 swung in a separating direction W2 toward the opposite side of the driving side separable contact roller 341*a* (anticlockwise direction in FIGS. 5 to 7) causes the driven side separable contact roller 341*b* to be separated from the driving side separable contact roller 341*a*. In this example, the first swing member 362 protrudes outward in a radial direction from the rotation shaft 361, and is bent at its intermediate portion toward the driving side separable contact roller 341*a* to be in an approximately L shape.

The restoring force delivery unit 364 pushes the first swing member 362 in a rotation direction of the rotation shaft 361 about the axis toward the driving side separable contact roller 341*a*. In this example, the restoring force delivery unit 364 is a torsion coil spring (what is known as a kick spring). The restoring force delivery unit 364 has one end portion provided to the rotation shaft 361 and engaged with (inserted in) an engagement hole (not illustrated) extending in a radial direction, and has the other end portion engaged with an engagement portion 362*c* provided to the first swing member 362. Thus, when the first swing member 362 swings in the pressure-contact direction W1 due to the pivoting of the rotation shaft 361 about the axis to cause the driven side separable contact roller 341*b* to be in contact with the driving side separable contact roller 341*a*, the restoring force delivery unit 364 can bring the driven side separable contact roller 341*b* to be in elastic pressure contact with the driving side separable contact roller 341*a*.

Instead of the restoring force delivery unit 364, the first swing member 362 may be an elastic member fixed to the rotation shaft 361.

The second swing member 363 is fixed to the other side (more specifically, the back surface side) of the rotation shaft 361 in the width direction X. In this example, the second swing member 363 is a rod shaped member protruding outward in the radial direction from the rotation shaft 361.

With the contact/separation mechanism 360 having the configuration described above, when the second swing member 363 swings in the pressure-contact direction W1, the first swing members 362 also swing in the pressure-contact direction W1 via the rotation shaft 361, whereby the driven side separable contact rollers 341*b* can be in pressure contact with the driving side separable contact rollers 341*a*. When the second swing member 363 swings in the separating direction W2, the first swing members 362 also swing in the separating direction W2 via the rotation shaft 361, whereby the driven side separable contact roller 341*b* can be separated from the driving side separable contact roller 341*a*.

(Solenoid)

The solenoid 370 is provided to a supporting member 306 fixed to the main body frame (not illustrated) of the document feeder main body 300*a*. The solenoid 370 is positioned at a predetermined position relative to the supporting member 306.

The solenoid 370 includes: a plunger 371 forming a movable iron core; and a solenoid main body 372 in which the plunger 371 moves in an insertion direction S1 and a protruding direction S2 along the horizontal direction Y.

The plunger 371 is movable in the insertion direction S1 and in the protruding direction S2, in an insertion hole 372*a* (see FIG. 8 described later) of the solenoid main body 372. Thus, the plunger 371 moves in the insertion direction S1 to be inserted into the solenoid main body 372, and moves in the protruding direction S2 to protrude from the solenoid main body 372.

The supporting member 306 includes a first regulating member 306*a* (more specifically, a stopper) that prevents the plunger 371 from excessively protruding in the protruding direction S2. The first regulating member 306*a* is provided on a straight line of movement of the plunger 371 in the protruding direction S2. Thus, the first regulating member 306*a* comes into contact with a distal end 371*a* of the plunger 371 moving in the protruding direction S2, whereby the plunger 371 is prevented from excessively protruding in the protruding direction S2.

The plunger 371 is provided with a second regulating member 371*b* (more specifically, an E ring) that prevents the plunger 371 from being excessively inserted in the insertion direction S1. The second regulating member 371*b* is disposed closer to the solenoid main body 372 than the distal end 371*a* of the plunger 371 by a predetermined amount. Thus, the second regulating member 371*b* comes into contact with the solenoid main body 372 when the plunger 371 moves in the insertion direction S1, and thus the plunger 371 can be prevented from being excessively inserted in the insertion direction S1.

(Coupling Between Contact/Separation Mechanism and Solenoid)

The contact/separation mechanism 360 is detachably attached to the solenoid 370. More specifically, the contact/separation mechanism 360 is coupled to the solenoid 370 in such a manner as to be rotatable about an axis along the width direction X.

In this example, the distal end portion of the plunger 371 in the solenoid 370 is provided with a first engagement groove 365 (see FIGS. 5 and 8) as an opening on the distal end formed to extend in a direction along the second swing member 363. An engaging member 366 (more specifically, a pin) extending along the width direction X penetrates through the first engagement groove 365.

The distal end portion of the second swing member 363 is provided with a second engagement groove 367 as an opening on the distal end formed to extend in a direction along the width direction X.

The engaging member 366 at the distal end portion of the plunger 371 is engaged with the second engagement groove 367 of the second swing member 363 in a state of having the distal end portion inserted in the first engagement groove 365 at the distal end portion of the plunger 371.

With the contact/separation mechanism 360 having the configuration described above, when the plunger 371 in the solenoid 370 is inserted in the insertion direction S1, the second swing member 363 can swing in the pressure-contact direction W1 via the engaging member 366 at the distal end portion of the plunger 371. When the plunger 371 in the solenoid 370 protrudes in the protruding direction S2, the second swing member 363 can swing in the separating direction W2 via the engaging member 366 at the distal end portion of the plunger 371.

In this example, the supporting member 306 is provided with a guide hole 368 that extends in a movement direction of the plunger 371 in the solenoid 370 and guides the engaging member 366. The guide hole 368 can restrict the rotation of the plunger 371 about the axis.

Figure 8:
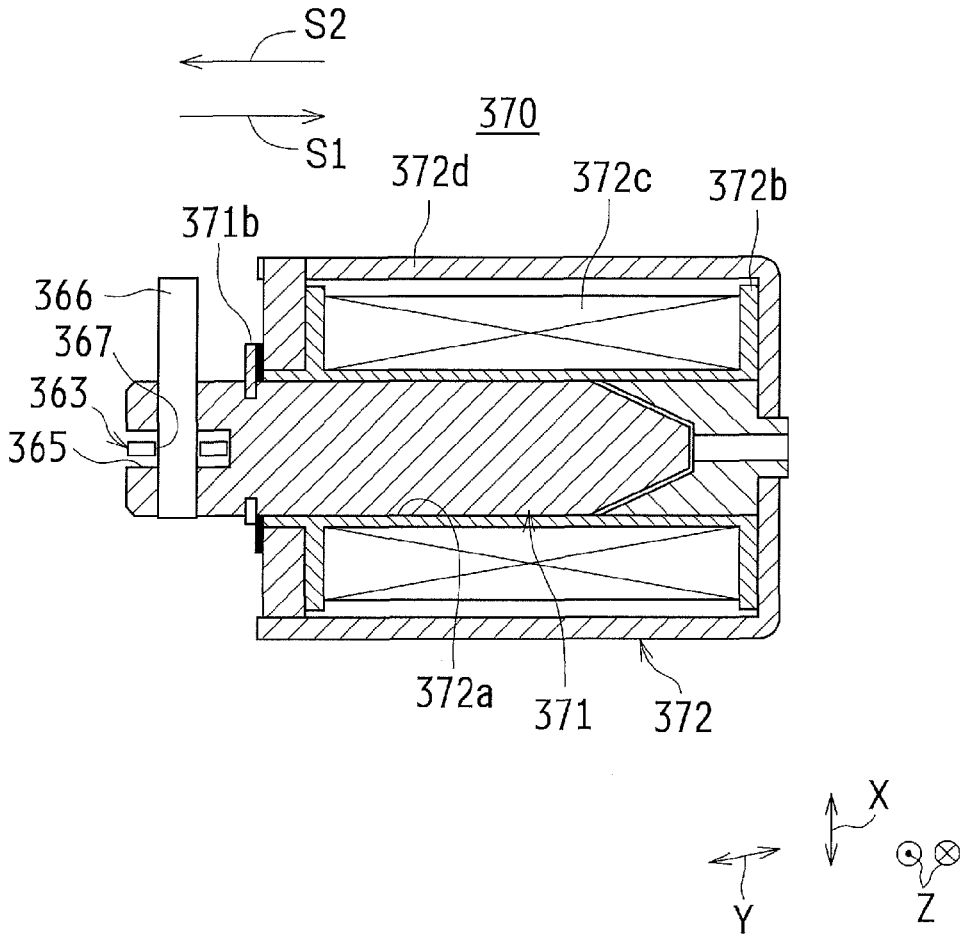
FIG. 8 is a schematic cross-sectional view illustrating an internal configuration of a solenoid coupled to the contact/separation mechanism.

FIG. 8 is a schematic cross-sectional view illustrating the internal configuration of the solenoid 370 coupled to the contact/separation mechanism 360. FIG. 8 illustrates a state where the plunger 371 in the solenoid 370 is inserted in the solenoid main body 372.

As illustrated in FIG. 8, the solenoid main body 372 includes: a bobbin 372*b*; a coil 372*c* wound around the bobbin 372*b*; and a yoke 372*d* that covers the bobbin 372*b* and the coil 372*c*. The insertion hole 372*a* in the solenoid main body 372 in which the plunger 371 is inserted in such a manner as to be movable in the insertion direction S1 and the protruding direction S2, is formed at the center in the width direction X and in the vertical direction Z.

(Pressure Contact and Separation Operations for Pair of Separable Contact Roller)

In the document feeder 300 having the configuration described above, when the coil 372*c* of the solenoid main body 372 is energized (turned ON), the electromagnetic force of the coil 372*c* causes the plunger 371 to move in the insertion direction S1 along the insertion hole 372*a* to be inserted into the solenoid main body 372 (see FIG. 6). Thus, the second swing member 363 swings in the pressure-contact direction W1 about the rotation shaft 361. This causes the first swing members 362 to swing in the pressure-contact direction W1 about the rotation shaft 361. As a result, the driven side separable contact rollers 341*b* at the distal end portions 362*b* of the first swing members 362 are pulled up to come into contact with the driving side separable contact rollers 341*a*. After the driven side separable contact rollers 341*b* comes into contact with the driving side separable contact rollers 341*a*, the rotation shaft 361 further rotates in the pressure-contact direction W1 with respect to the first swing member 362 against restoring force delivered by the restoring force delivery unit 364. Thus, the restoring force delivery unit 364 delivers the restoring force so that the driven side separable contact roller 341*b* is moved in the pressure-contact direction W1, whereby the driven side separable contact roller 341*b* comes into pressure contact with the driving side separable contact roller 341*a* at the distal end portion 362*b* of the first swing member 362. In this state, when the driving side separable contact roller 341*a* is drivingly rotated, the driven side separable contact roller 341*b* is driven to be rotated.

When the coil 372*c* of the solenoid main body 372 is de-energized (turned OFF), the plunger 371 is no longer affected by the electromagnetic force of the coil 372*c*. As illustrated in FIG. 6, when the coil 372*c* is energized, the driven side separable contact roller 341*b* at the distal end portion 362*b* of the first swing member 362 is moved, in the pressure-contact direction W1, against the rotation shaft 361, by the restoring force delivered by the restoring force delivery unit 364. Thus, when the coil 372*c* that has been energized is de-energized, the driven side separable contact roller 341*b* moves away from the driving side separable contact roller 341*a* in the separating direction W2 (see FIG. 7). Thus, the first swing member 362 is further swung in the separating direction W2 by its own weight about the rotation shaft 361. Thus, the driven side separable contact roller 341*b* is separated from the driving side separable contact roller 341*a*. At the same time, the second swing member 363 also swings in the separating direction W2 about the rotation shaft 361. Thus, the plunger 371 moves in the protruding direction S2 along the insertion hole 372*a* to protrude from the solenoid main body 372.

The contact/separation mechanism 360 may further include a restoring force delivery unit (for example, a series spring) that delivers restoring force to the plunger 371 in the protruding direction S2. In this configuration, the driven side separable contact roller 341*b* can certainly be separated from the driving side separable contact roller 341*a*.

[Document Conveyance Operation in Document Feeder]

Next, a document conveyance operation of conveying the document G in the document feeder 300 is described below with reference to FIGS. 9 and 10.

Figure 9:
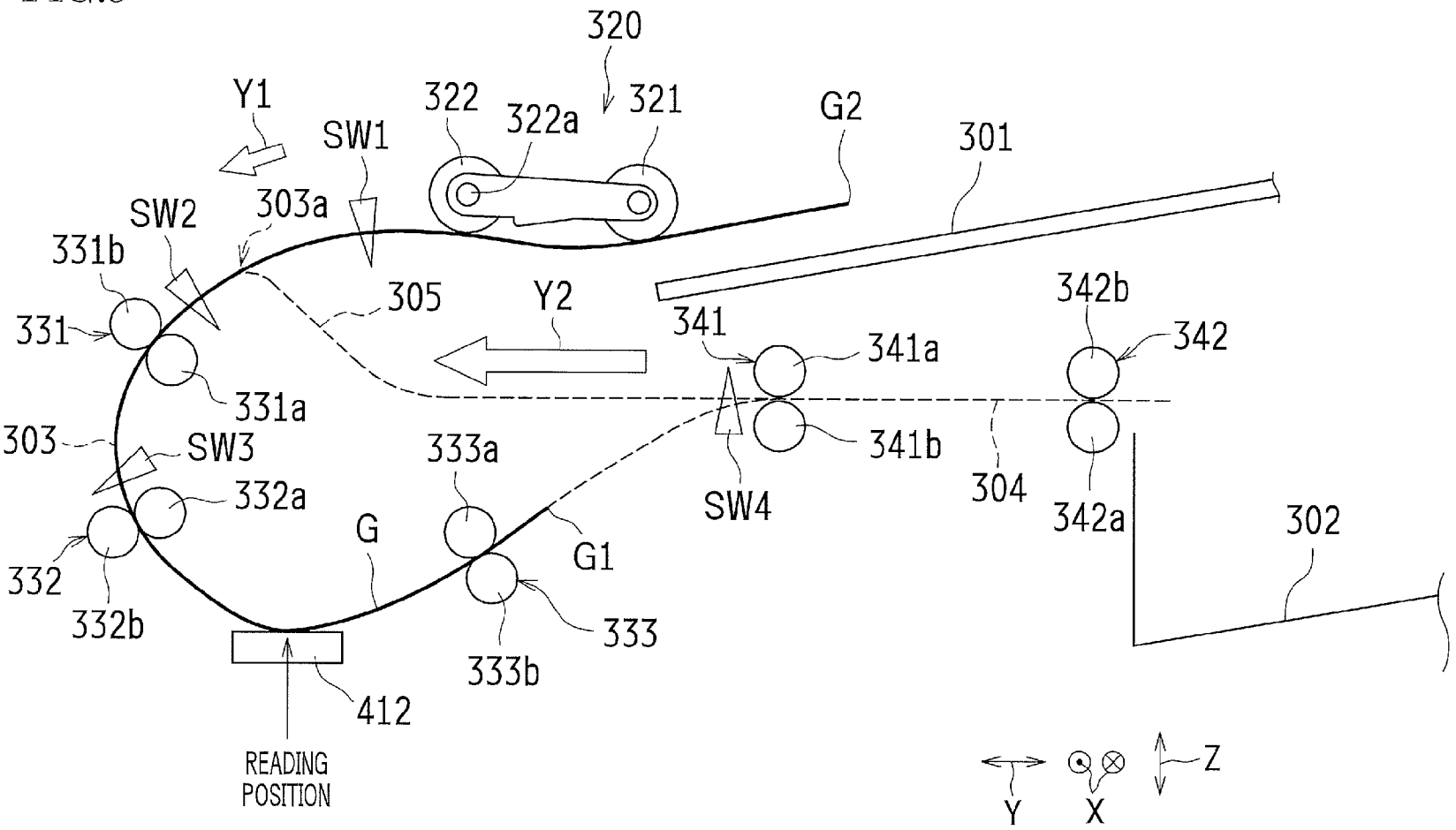
FIG. 9 is a diagram illustrating a document conveyance operation of conveying a document in the document feeder.
Figure 10:
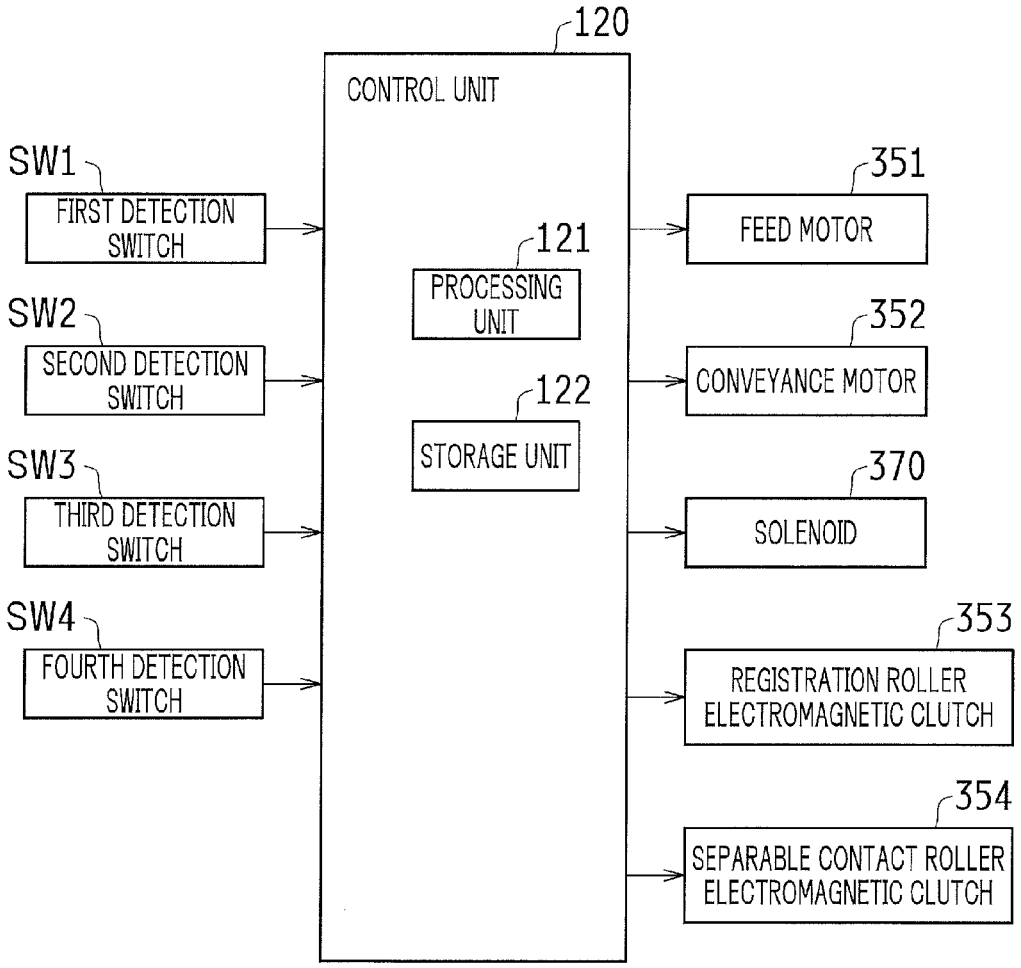
FIG. 10 is a system block diagram illustrating the document conveyance operation configuration in the document feeder.

FIG. 9 is a diagram illustrating the document conveyance operation of conveying the document G in the document feeder 300. FIG. 10 is a system block diagram illustrating a document conveyance operation configuration of the document feeder 300.

The image forming apparatus 100 further includes the control unit 120 (see FIG. 10) in charge of controlling the entire image forming apparatus 100. The control unit 120 may be a component of the image reading device 200.

The document feeder 300 further includes a plurality of detection switches (a first detection switch SW1 to a fourth detection switch SW4 in this example) that detect a conveyance timing of the document G.

The first detection switch SW1 is disposed more on the downstream side than the sheet feed roller 322 and more on the upstream side of a joint portion 303*a* between the sheet conveyance path 303 and the switchback conveyance path 305, in the conveyance direction Y1. The first detection switch SW1 detects a leading edge G1 of the document G conveyed from the sheet feed device 320. The first detection switch SW1 is electrically connected to an input system of the control unit 120, and transmits a first timing signal to the control unit 120. The first timing signal indicates the timing of arrival of the leading edge G1 of the document G conveyed from the sheet feed device 320. Thus, the control unit 120 can detect (recognize) that the document G is transmitted from the sheet feed device 320, based on the first timing signal.

The second detection switch SW2 is disposed more on the downstream side than the joint portion 303*a*, and more on the upstream side than the pair of registration rollers 331, in the conveyance direction Y1. The second detection switch SW2 detects the leading edge G1 of the document G arriving at the pair of registration rollers 331. The second detection switch SW2 is electrically connected to the input system of the control unit 120, and transmits a second timing signal to the control unit 120. The second timing signal indicates the timing at which the leading edge G1 of the document G arrives at the pair of registration rollers 331. Thus, the control unit 120 can detect (recognize) the arrival of the document G at the pair of registration rollers 331, based on the second timing signal.

The third detection switch SW3 is disposed more on the downstream side than the pair of registration rollers 331 and more on the upstream side than the pair of upstream side conveyance rollers 332, in the conveyance direction Y1. The third detection switch SW3 detects the leading edge G1 of the document G arriving at the pair of upstream side conveyance rollers 332. The third detection switch SW3 is electrically connected to the input system of the control unit 120, and transmits a third timing signal to the control unit 120. The third timing signal indicates the timing at which the leading edge G1 of the document G arrives at the pair of upstream side conveyance rollers 332. Thus, the control unit 120 can detect (recognize) the arrival of the document G at the pair of upstream side conveyance rollers 332, based on the third timing signal.

The fourth detection switch SW4 is disposed more on the downstream side than the pair of downstream side conveyance rollers 333, and more on the upstream side than the pair of separable contact rollers 341, in the conveyance direction Y1. The fourth detection switch SW4 detects the leading edge G1 of the document G arriving at the pair of separable contact rollers 341. The fourth detection switch SW4 is electrically connected to the input system of the control unit 120, and transmits a fourth timing signal to the control unit 120. The fourth timing signal indicates the timing at which the leading edge G1 of the document G arrives at the pair of separable contact rollers 341. Thus, the control unit 120 can detect (recognize) the arrival of the document G at the pair of separable contact rollers 341, based on the fourth timing signal.

The control unit 120 (see FIG. 10) includes: a processing unit 121 including a microcomputer such as a central processing unit (CPU); and a storage unit 122 including a nonvolatile memory such as a read only memory (ROM) and a volatile memory such as a random access memory (RAM). The control unit 120 performs operation control for each component, with the processing unit 121 loading a control program stored in advance in the ROM of the storage unit 122 onto the RAM of the storage unit 122 and executing the control program. The RAM of the storage unit 122 provides a work area for the processing unit 121 to perform the operation and an area serving as an image memory storing image data.

The control unit 120 has an output system electrically connected to the feed motor 351, the conveyance motor 352, the solenoid 370, the registration roller electromagnetic clutch 353, and the separable contact roller electromagnetic clutch 354. The control unit 120 performs the operation control for the feed motor 351, the conveyance motor 352, the solenoid 370, the registration roller electromagnetic clutch 353, and the separable contact roller electromagnetic clutch 354.

In the document feeder 300, first of all, the control unit 120 rotates the feed motor 351 to pick up the document G on the document tray 301 with the sheet feed roller 322 and the pickup roller 321 in the sheet feed device 320, and feeds the document G to the sheet conveyance path 303. In this process, the control unit 120 recognizes that the document G is transmitted from the sheet feed device 320 based on the first timing signal from the first detection switch SW1. Then, the control unit 120 puts the registration roller electromagnetic clutch 353 in the driving force shutoff state so that the pair of registration rollers 331 are temporarily stopped, while causing the normal rotation of the conveyance motor 352.

Then, the control unit 120 recognizes that the document G has arrived at the pair of registration rollers 331 based on the second timing signal from the second detection switch SW2. The control unit 120 stops the conveyance of the document G after a predetermined period of time has elapsed after the detection of the second timing signal, so that the leading edge G1 of the document G abuts on the pair of registration rollers 331 to be in register.

Next, the control unit 120 puts the registration roller electromagnetic clutch 353 in the driving force transmission state, and rotates the pair of registration rollers 331 so that the conveyance of the document G starts. Then, the control unit 120 recognizes that the document G has arrived at the pair of upstream side conveyance rollers 332 based on the third timing signal from the third detection switch SW3.

Next, the control unit 120 conveys the document G with the pair of upstream side conveyance rollers 332 and the pair of downstream side conveyance rollers 333. The control unit 120 starts reading of an image on one surface (front surface) of the document G passing through the reading position on the document reading glass member 412, after a predetermined period of time has elapsed after the detection of the third timing signal.

Next, the control unit 120 energizes the coil 372*c* of the solenoid 370, whereby the driven side separable contact roller 341*b* comes into pressure contact with the driving side separable contact roller 341*a* (solenoid driving operation). Then, the control unit 120 puts the separable contact roller electromagnetic clutch 354 in the driving force transmission state, so that the pair of separable contact rollers 341 and the pair of discharge rollers 342 are rotated. Thus, the document G is transmitted to the pair of discharge rollers 342 by the pair of separable contact rollers 341. In this process, the control unit 120 recognizes that the document G has arrived at the pair of separable contact rollers 341, based on the fourth timing signal from the fourth detection switch SW4. Then, the control unit 120 causes the document G to be conveyed to the discharge tray 302 by the pair of discharge rollers 342, and thus the document G is discharged onto the discharge tray 302.

The control unit 120 reads an image on the other surface (back surface) of the document G by reversing the document G as follows. More specifically, the conveyance motor 352 is stopped after a predetermined period of time has elapsed after the fourth timing signal is detected so that the pair of separable contact rollers 341 and the pair of discharge rollers 342 are stopped, while the discharging of the document G to the discharge tray 302 with the pair of separable contact rollers 341 and the pair of discharge rollers 342 is in process. Then, the control unit 120 rotates the conveyance motor 352 in the reverse direction so that the pair of separable contact rollers 341 and the pair of discharge rollers 342 are rotated in the reverse direction. Thus, the document G is conveyed to the pair of registration rollers 331 again through the switchback conveyance path 305. In this process, the control unit 120 puts the registration roller electromagnetic clutch 353 in the driving force shutoff state so that the pair of registration rollers 331 are temporarily stopped, whereby the leading edge G1 of the document G that has been reversed abut on the pair of registration rollers 331 to be in register, as in the case where one surface (front surface) of the document G is read.

The control unit 120 temporarily stops the conveyance motor 352 and then rotates the conveyance motor 352 again in the normal direction, as in the case where one surface (front surface) of the document G is read. The control unit 120 connects the registration roller electromagnetic clutch 353 in a period between the point where the conveyance motor 352 is stopped and the point where the conveyance motor 352 is rotated again in the normal direction, whereby the pair of registration rollers 331 can be drivingly rotated. After rotating the conveyance motor 352 in the normal direction again, the control unit 120 de-energizes the coil 372*c* of the solenoid 370 so that the driven side separable contact roller 341*b* is separated from the driving side separable contact roller 341*a* (solenoid driving cancel operation). Then, the control unit 120 puts the separable contact roller electromagnetic clutch 354 in the driving force shutoff state, so that the pair of separable contact rollers 341 and the pair of discharge rollers 342 can be rotated. Thus, the control unit 120 drivingly rotates the pair of registration rollers 331 so that the document G is conveyed in the reverse conveyance direction Y2.

Thereafter, operations as in the case where one surface (front surface) of the document G is read are performed. More specifically, the control unit 120 conveys the document G with the pair of upstream side conveyance rollers 332 and the pair of downstream side conveyance rollers 333, so that the document G passes through the reading position on the document reading glass member 412. The control unit 120 energizes the coil 372*c* of the solenoid 370 so that the driven side separable contact roller 341*b* comes into pressure contact with the driving side separable contact roller 341*a* (solenoid driving operation). The control unit 120 engages the separable contact roller electromagnetic clutch 354 so that the pair of separable contact rollers 341 and the pair of discharge rollers 342 rotate in the normal direction, whereby the document G is conveyed by the pair of separable contact rollers 341 to the pair of discharge rollers 342. Then, the document G is conveyed to the discharge tray 302 and discharged onto the discharge tray 302 by the pair of discharge rollers 342.

Figure 11:
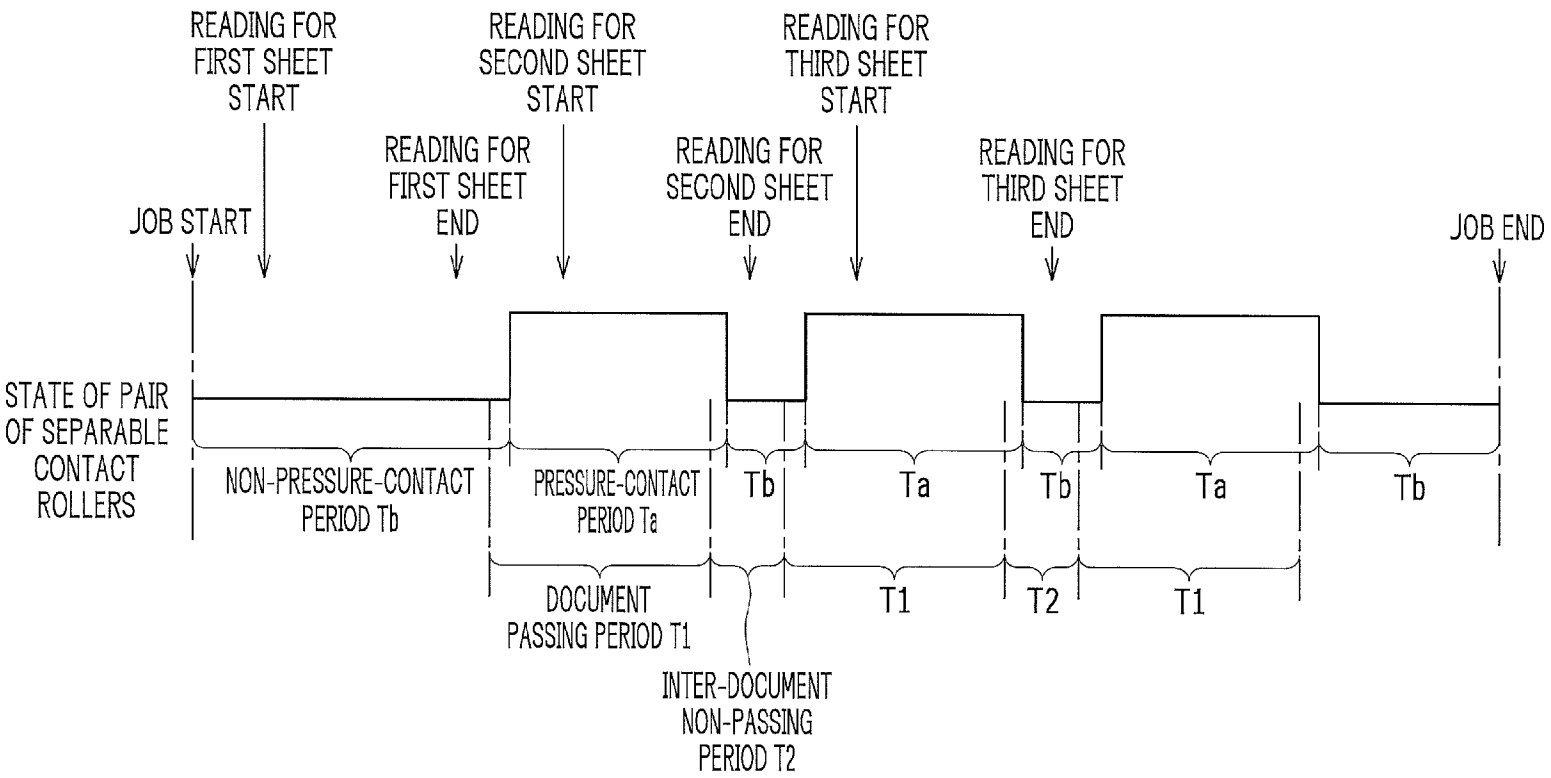
FIG. 11 is a timing chart illustrating how the solenoid is driven in a conventional control configuration.

FIG. 11 is a timing chart illustrating how the solenoid 370 is driven in the conventional control configuration.

FIG. 11 illustrates operations that have conventionally been performed by the document feeder 300 to convey a plurality of documents G to G one by one at an interval when one surfaces (front surfaces) of the documents G are read. More specifically, in the conventional configuration, the temperature rise of the solenoid 370 that has been energized is prevented with the solenoid 370 only driven in a period during which the pair of separable contact rollers 341 are to be in pressure contact with each other (for example, in a document passing period T1 in which each of the documents G to G passes through the pair of separable contact rollers 341) (pressure-contact period Ta). The solenoid 370 is not driven in the other period (for example, an inter-document non-passing period T2 between conveyance operations for two consecutive documents G,G performed by the pair of separable contact rollers 341) (non-pressure-contact period Tb). The pressure-contact period Ta during which the pair of separable contact rollers 341 are to be in pressure contact with each other includes at least a period during which the pair of separable contact rollers 341 alone convey the document G.

Thus, in the conventional control configuration, the plurality of documents G to G have been conveyed one by one at an interval with the solenoid driving operation and the solenoid driving cancel operation repeated. The solenoid driving operation is performed to drive the solenoid 370 to put the pair of separable contact rollers 341 in the pressure-contact state in the pressure-contact period Ta in which the pair of separable contact rollers 341 are to be in pressure contact with each other in the document passing period T1. The solenoid driving cancel operation is performed in the non-pressure-contact period Tb as the other period so that the driving of the solenoid 370 is cancelled to put the pair of separable contact rollers 341 in the separated state.

The conventional control configuration, in which the plurality of the documents G to G have been conveyed one by one at an interval with the solenoid driving operation and the solenoid driving cancel operation repeatedly performed, has the following disadvantage. More specifically, the operations of putting the pair of separable contact rollers 341 in the pressure-contact state and the separated state are repeated every time a sheet of document G passes. Thus, the solenoid driving operation and the solenoid driving cancel operation are repeated, causing the intermittent operating noise of the solenoid 370 (more specifically, the operating noise of the pair of separable contact rollers 341), which can make a user irritated.

Figure 12:
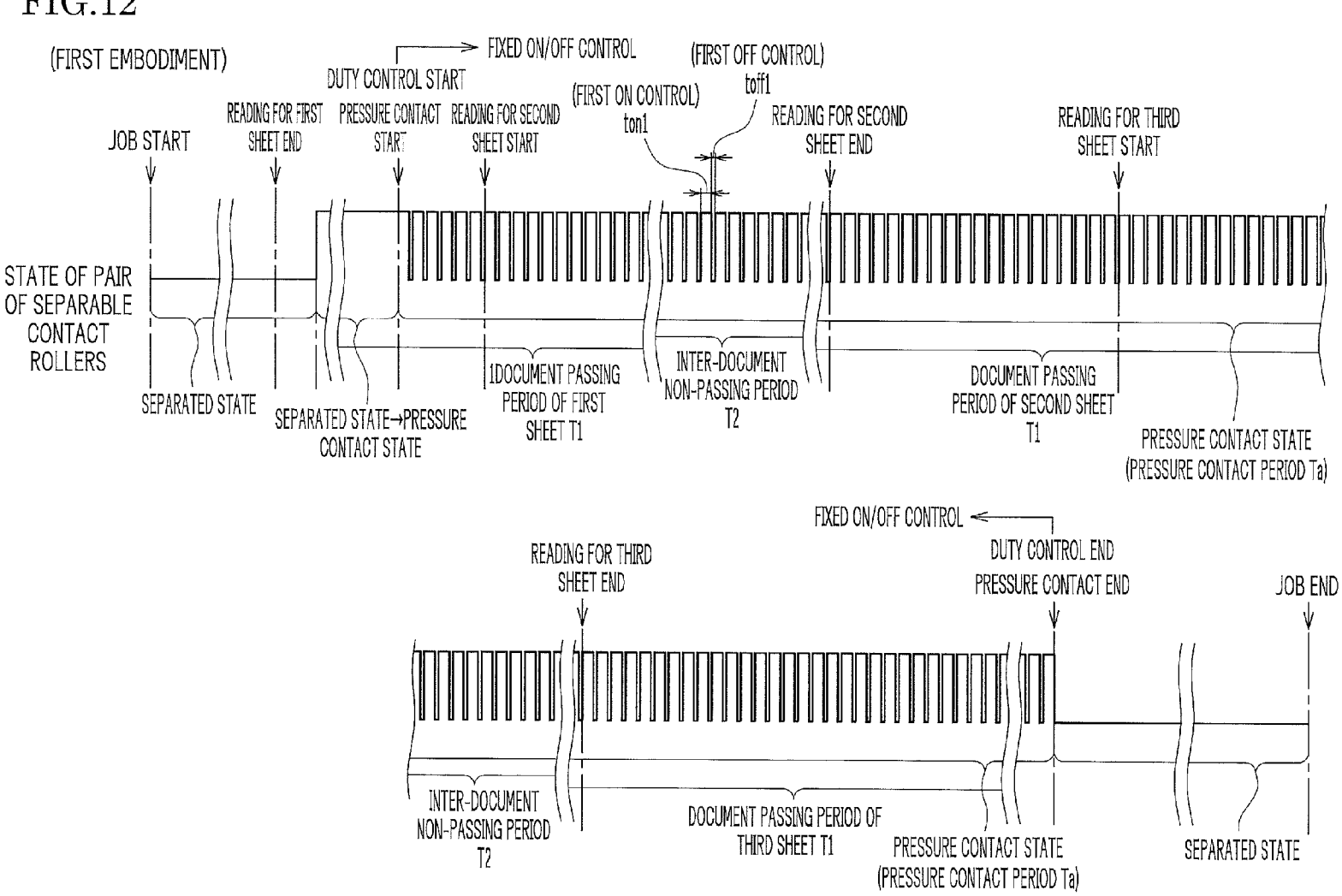
FIG. 12 is a timing chart illustrating how the solenoid is driven in a control configuration according to a first embodiment.
Figure 13:
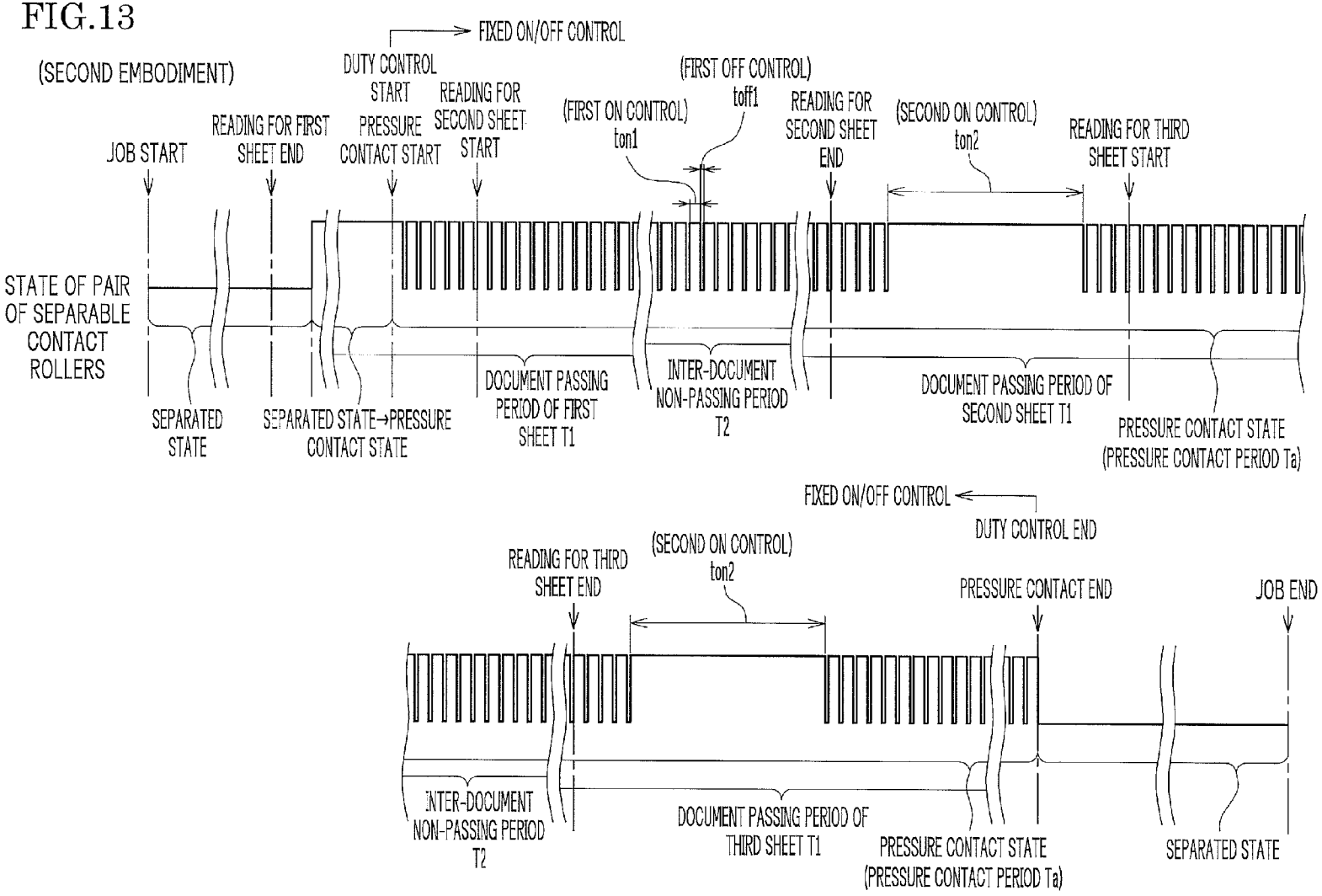
FIG. 13 is a timing chart illustrating how the solenoid is driven in a control configuration according to a second embodiment.

In view of the above, in the present embodiment, as illustrated in FIGS. 12 and 13 described later, the control unit 120 conveys the plurality of documents G to G one by one at an interval with pulse width modulation (PWM) duty control performed on the solenoid 370 while the pair of separable contact rollers 341 are in pressure contact with each other. Thus, the solenoid 370 is driven under the PWM duty control to make the pair of separable contact rollers 341 constantly in pressure contact with each other (constantly in pressure contact with each other regardless of whether the current state is the document passing period T1 or the inter-document non-passing period T2).

First Embodiment

FIG. 12 is a timing chart illustrating how the solenoid 370 is driven in the control configuration according to a first embodiment. The timing chart according to the first embodiment in FIG. 12 illustrates an example where three documents G to G are conveyed one by one at an interval at conveyance speed of 400 mm/s. This applies to a timing chart according to a second embodiment illustrated in FIG. 13 described later.

In the first embodiment, as illustrated in FIG. 12, the duty control includes fixed ON/OFF control. In the fixed ON/OFF control, first ON control and first OFF control are repeated. The first ON control is performed so that the solenoid 370 is turned ON for a predetermined fixed first ON time ton1 in the pressure-contact period Ta during which the pair of separable contact rollers 341 are in the pressure-contact state. The first OFF control is performed so that the solenoid 370 is turned OFF for a predetermined fixed first OFF time toff1. The first ON time ton1 is longer than the first OFF time toff1. More specifically, the first ON time ton1 is 3 ms, whereas the first OFF time toff1 is 1 ms.

Second Embodiment

Figure 14:
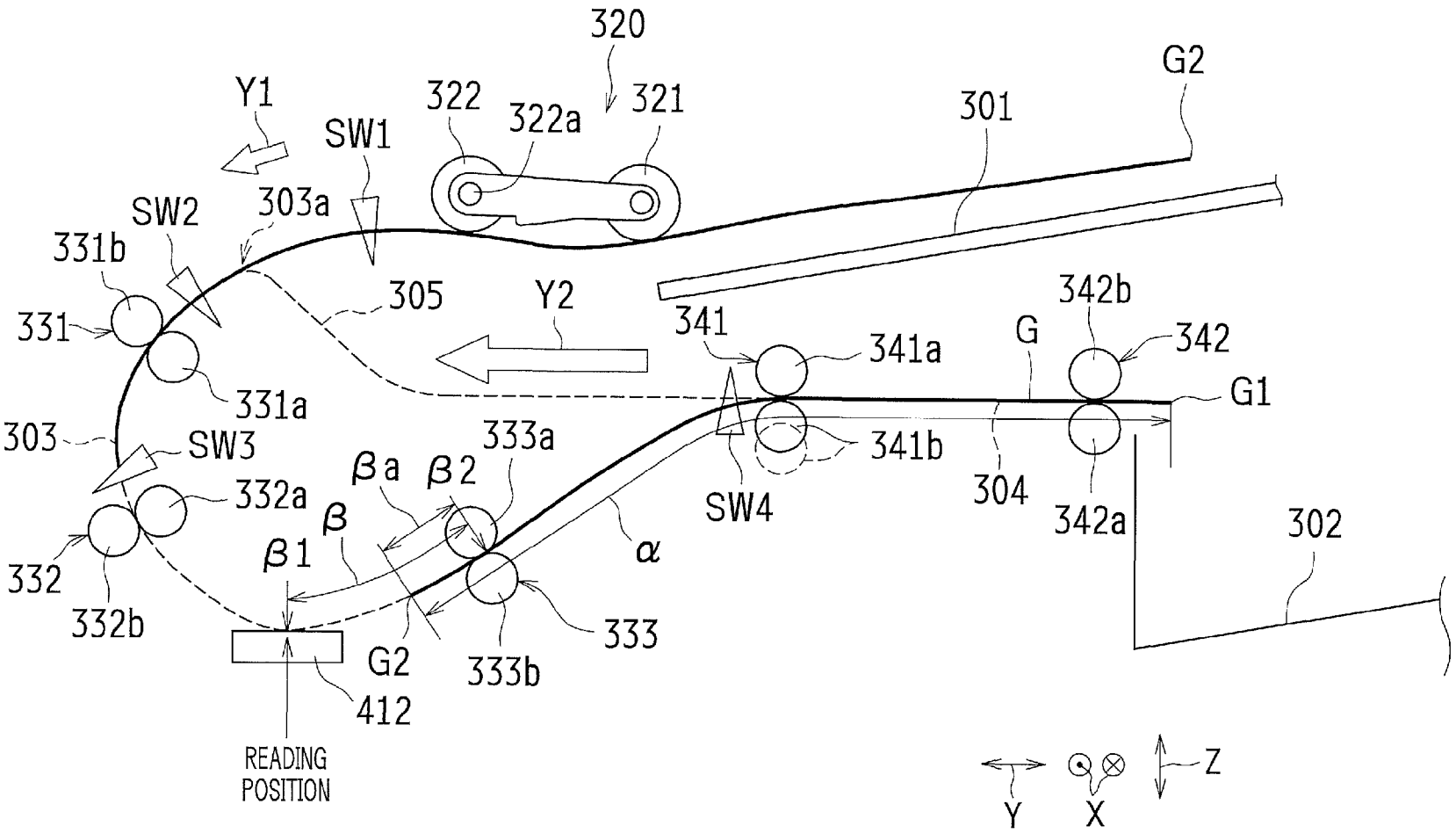
FIG. 14 is a diagram illustrating a document conveyance operation according to the second embodiment.

FIG. 13 is the timing chart illustrating how the solenoid 370 is driven in a control configuration according to the second embodiment. FIG. 14 is a diagram illustrating a document conveyance operation according to the second embodiment.

In the second embodiment, the fixed ON/OFF control further includes second ON control. The second ON control is performed so that the solenoid 370 is turned ON for a predetermined second ON time ton2 (see FIG. 13) in a document conveyance period α (see FIG. 14) (an example of the sheet conveyance period) in which the pair of downstream side conveyance rollers 333 convey the document G.

The second ON time ton2 is longer than the first ON time ton1. More specifically, the second ON time ton2 is 50 ms.

More specifically, the second ON control is performed entirely or partially in a specific period β (see FIG. 14) in the document conveyance period α. The specific period β is a period during which a trailing edge G2 of the document G, conveyed by the pair of downstream side conveyance rollers 333, is positioned between a reading position β1 (see FIG. 14) for the document G and a nip position β2 (see FIG. 14) of the pair of downstream side conveyance rollers 333.

In this example, the specific period β may be set as a period between a predetermined timing before the trailing edge G2 of the document G passes through the nip position β2 of the pair of downstream side conveyance rollers 333 and a timing at which the trailing edge G2 passes through the nip position β2 of the pair of downstream side conveyance rollers 333. In the specific period β, the leading edge G1 of the subsequent document G has not reached the reading position β1 for the document G. The specific period β may be not shorter than the second ON time ton2 (more specifically, 50 ms). The specific period β may be set as a predetermined period after a timing at which the third detection switch SW3 has detected the leading edge G1 of the document G. More specifically, the specific period β (βa in FIG. 13) is 120 ms which corresponds to the distance of 48 mm between the nip position β2 of the pair of downstream side conveyance rollers 333 and the trailing edge G2 of the document G.

Third Embodiment and Fourth Embodiment

Figure 15:
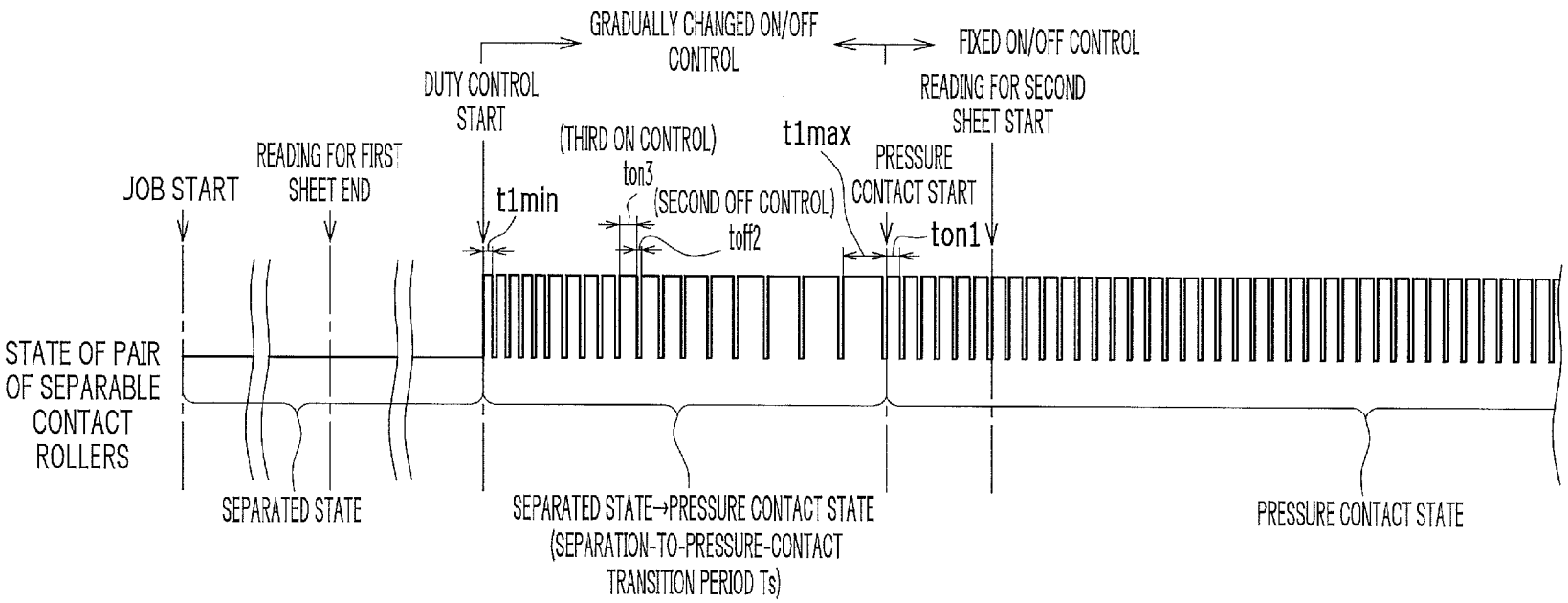
FIG. 15 is a timing chart illustrating how the solenoid is driven in a control configuration according to a third embodiment.
Figure 16:
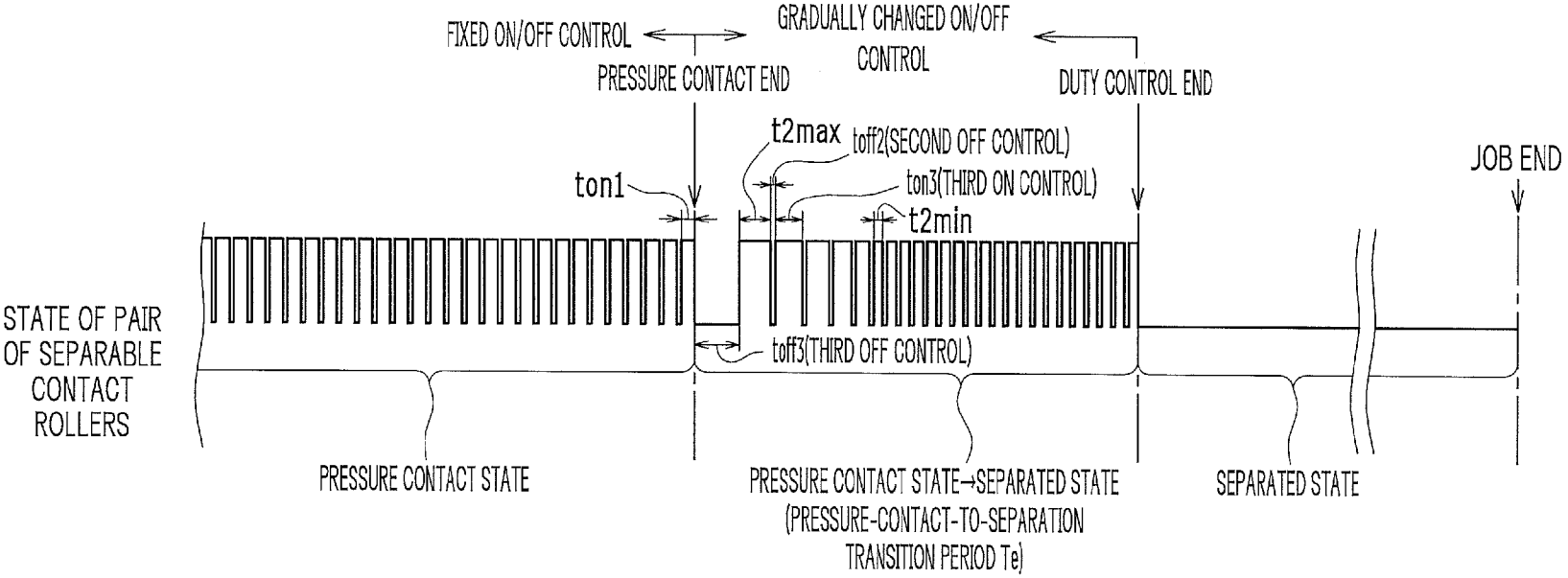
FIG. 16 is a timing chart illustrating how the solenoid is driven in a control configuration according to a fourth embodiment.

FIGS. 15 and 16 are timing charts illustrating how the solenoid 370 is driven in the control configurations respectively according to a third embodiment and a fourth embodiment.

In the third embodiment and the fourth embodiment, the PWM duty control is performed in at least one of a separation-to-pressure-contact transition period Ts and a pressure-contact-to-separation transition period Te (in this example, the PWM duty control is performed in both the separation-to-pressure-contact transition period Ts and the pressure-contact-to-separation transition period Te). In the separation-to-pressure-contact transition period Ts, the pair of separable contact rollers 341 in the separated state transition to the pressure-contact state (see FIG. 15). In the pressure-contact-to-separation transition period Te, the pair of separable contact rollers 341 in the pressure-contact state transition to the separated state (see FIG. 16).

More specifically, gradually changed ON/OFF control is performed in at least one of the separation-to-pressure-contact transition period Ts and the pressure-contact-to-separation transition period Te (in this example, in both the separation-to-pressure-contact transition period Ts and the pressure-contact-to-separation transition period Te). The gradually changed ON/OFF control is control of repeating third ON control and second OFF control. In the third ON control, the solenoid 370 is turned ON for a predetermined third ON time ton3 that gradually changes. In the second OFF control, the solenoid 370 is turned OFF for a predetermined fixed second OFF time toff2.

Third Embodiment

As illustrated in FIG. 15, in the third embodiment, the gradually changed ON/OFF control performed in the separation-to-pressure-contact transition period Ts is control of gradually increasing the third ON time ton3.

More specifically, the control of gradually increasing the third ON time ton3 is performed between a predetermined minimum start time t1min and a predetermined maximum end time t1max. In this example, the minimum start time t1min is shorter than the first ON time ton1 and the maximum end time t1max is longer than the first ON time ton1.

In the third embodiment, the coil 372*c* is energized under the gradually changed ON/OFF control, when the plunger 371 in the solenoid 370 is inserted into the solenoid main body 372.

When the coil 372*c* in the solenoid main body 372 is started to be energized under the gradually changed ON/OFF control, the suction operation starts for the plunger 371, whereby the pair of separable contact rollers 341 in the separated state transition to the pressure-contact state.

In the separation-to-pressure-contact transition period Ts, the third ON time ton3 during which the coil 372*c* is energized is extended from the minimum start time t1min to the maximum end time t1max, by being incremented by a predetermined first amount at a time for a plurality of stages (eight stages in this example).

More specifically, the minimum start time t1min is 2 ms and thus is shorter than the first ON time ton1 which is 3 ms. The maximum end time t1max is 9 ms and thus is longer than the first ON time ton1 which is 3 ms. The first amount and the second OFF time toff2 are each 1 ms.

More specifically, at the first stage, the ON/OFF control is repeated for five times. In this ON/OFF control, the solenoid 370 is ON for the third ON time ton3 which is 2 ms (minimum start time t1min), and is OFF for the second OFF time toff2 which is 1 ms. At the second stage, the ON/OFF control is repeated for four times. In this ON/OFF control, the solenoid 370 is ON for the third ON time ton3 which is 3 ms, and is OFF for the second OFF time toff2 which is 1 ms. At the third stage, the ON/OFF control is repeated for three times. In this ON/OFF control, the solenoid 370 is ON for the third ON time ton3 which is 4 ms, and is OFF for the second OFF time toff2 which is 1 ms. At the fourth stage, the ON/OFF control is repeated for two times. In this ON/OFF control, the solenoid 370 is ON for the third ON time ton3 which is 5 ms, and is OFF for the second OFF time toff2 which is 1 ms. In the fifth to the eighth stages, the ON/OFF control is performed for a single time, and in this ON/OFF control, the solenoid 370 is ON for third ON time ton3 which are 6 ms, 7 ms, 8 ms, and 9 ms (maximum end time t1max), respectively, and is OFF for the second OFF time toff2 which is 1 ms.

The third ON time ton3 may be randomly changed between the minimum start time t1min and the maximum end time t1max, in such a manner as to be gradually increased as a whole (to achieve an average increase with a plurality of contiguous stages), without falling below the minimum start time t1min or exceeding the maximum end time t1max. For example, the third ON time ton3 described above might be swapped between the third and the fourth stages, or between the fifth and the sixth stages.

Fourth Embodiment

As illustrated in FIG. 16, in the fourth embodiment, the gradually changed ON/OFF control performed in the pressure-contact-to-separation transition period Te is control of gradually decreasing the third ON time ton3.

The control of gradually decreasing the third ON time ton3 is performed between a predetermined maximum start time t2max and a predetermined minimum end time t2min. In this example, the maximum start time t2max is longer than the first ON time ton1, and the minimum end time t2min is shorter than the first ON time ton1.

In this example, the control of gradually decreasing the third ON time ton3 includes third OFF control of turning the solenoid 370 OFF for a predetermined third OFF time toff3 immediately before the maximum start time t2max. The third OFF time toff3 is longer than the maximum start time t2max.

In the fourth embodiment, the coil 372*c* is energized under the gradually changed ON/OFF control, when the plunger 371 in the solenoid 370 protrudes from the solenoid main body 372.

When the coil 372*c* in the solenoid main body 372 is started to be energized under the gradually changed ON/OFF control, a protrusion operation starts for the plunger 371, whereby the pair of separable contact rollers 341 in the pressure-contact state transition to the separated state.

In the pressure-contact-to-separation transition period Te, the third ON time ton3 during which the coil 372*c* is energized is reduced from the maximum start time t2max to the minimum end time t2min, by being decremented by a predetermined second amount at a time for a plurality of stages (six stages in this example).

More specifically, the maximum start time t2max is 7 ms and thus is longer than the first ON time ton1 which is 3 ms. The minimum end time t2min is 2 ms and thus is shorter than the first ON time ton1 which is 3 ms. The second amount and the second OFF time toff2 are each 1 ms.

More specifically, at the first stage, the ON/OFF control is performed for a single time. In this ON/OFF control, the solenoid 370 is ON for the third ON time ton3 which is 7 ms (maximum start time t2max), and is OFF for the second OFF time toff2 which is 1 ms. At the second stage, the ON/OFF control is performed for a single time. In this ON/OFF control, the solenoid 370 is ON for the third ON time ton3 which is 6 ms, and is OFF for the second OFF time toff2 which is 1 ms. At the third stage, the ON/OFF control is performed for a single time. In this ON/OFF control, the solenoid 370 is ON for the third ON time ton3 which is 5 ms, and is OFF for the second OFF time toff2 which is 1 ms. At the fourth stage, the ON/OFF control is performed for a single time. In this ON/OFF control, the solenoid 370 is ON for the third ON time ton3 which is 4 ms, and is OFF for the second OFF time toff2 which is 1 ms. At the fifth stage, the ON/OFF control is performed for a single time. In this ON/OFF control, the solenoid 370 is ON for the third ON time ton3 which is 3 ms, and is OFF for the second OFF time toff2 which is 1 ms. At the sixth stage, the ON/OFF control is repeated for 20 times. In this ON/OFF control, the solenoid 370 is ON for the third ON time ton3 which is 2 ms (minimum end time t2min), and is OFF for the second OFF time toff2 which is 1 ms.

The solenoid 370 is turned OFF for the third OFF time toff3 which is 10 ms longer than the maximum start time t2max, immediately before the maximum start time t2max which is 7 ms.

The third ON time ton3 may be randomly changed between the maximum start time t2max and the minimum end time t2min, in such a manner as to be gradually decreased as a whole (to achieve an average decrease with a plurality of contiguous stages), without exceeding the maximum start time t2max or falling below the minimum end time t2min. For example, the third ON time ton3 described above might be swapped between the first and the second stages, or between the third and the fourth stages.

OTHER EMBODIMENTS

The sheet conveyance device, applied to the document feeder 300 in the present embodiment, may also be applied to the sheet conveyance device 112 that conveys the recording sheet P as a sheet, more specifically, to the sheet conveyance device 112 with the discharge rollers 36 serving as the pair of separable contact rollers.

Overview of the Embodiments

In the embodiments (the first embodiment to the fourth embodiment), when the pair of separable contact rollers 341 are brought into pressure contact with each other, the solenoid 370 is driven under the PWM duty control. Thus, the ON time during which the solenoid 370 is ON (the energizing time during which the solenoid 370 is energized), and the OFF time during which the solenoid 370 is OFF (the non-energizing time during which the solenoid 370 is not energized) can be adjusted. Therefore the temperature rise of the solenoid 370 that has been energized can be prevented. Furthermore, the PWM duty control is performed on the solenoid 370 while the pair of separable contact rollers 341 are in pressure contact with each other when a plurality of sheets (the documents G in this example) are conveyed one by one at an interval. Thus, with the solenoid 370 driven under the PWM duty control, the pair of separable contact rollers 341 can be constantly be in the pressure contact with each other, so as not to be in the pressure-contact state and the separated state repeatedly every time the sheet passes as in the conventional case. All things considered, the intermittent operating noise of the solenoid 370 due to the repeated solenoid driving operation and the solenoid driving cancel operation (more specifically, intermittent operating noise of the pair of separable contact rollers 341) can be prevented. Therefore the user can be effectively prevented from being irritated by the operating noise of the solenoid 370.

In the present embodiment, the duty control includes the fixed ON/OFF control of repeating the first ON control and the first OFF control in the pressure-contact period Ta in which the pair of separable contact rollers 341 are in the pressure-contact state. The first ON control is performed to turn the solenoid 370 ON for the predetermined fixed first ON time ton1 (see FIGS. 12 and 13). The first OFF control is performed to turn the solenoid 370 OFF for the predetermined fixed first OFF time toff1 (see FIGS. 12 and 13). Thus, the ON time during which the solenoid 370 is ON (the energizing time during which the solenoid is energized), and the OFF time during which the solenoid 370 is OFF (the non-energizing time during which the solenoid is not energized) can be certainly adjusted with a simple control configuration while the pair of separable contact rollers 341 are in the pressure-contact state. All things considered, pressure contact force between the pair of separable contact rollers 341 brought into pressure contact with each other by the solenoid 370 can be certainly maintained while maintaining the effect of preventing the temperature rise of the solenoid 370 that has been energized.

In the present embodiment, the first ON time ton1 is longer than the first OFF time toff1. Thus, the pressure contact force between the pair of separable contact rollers 341 brought into pressure contact with each other by the solenoid 370 can be more certainly maintained.

The solenoid 370 is driven under the duty control (including the OFF control performed while the pair of separable contact rollers 341 are in the pressure-contact state). Thus, when the solenoid 370 is driven under the duty control, it is undeniable that the separable contact roller pair 341 in the pressure-contact state might be separated unintentionally for some reason. In this case, it leads to a situation where the pair of separable contact rollers cannot convey the sheet (the document G in this example).

In view of this, in the present embodiment, the pair of conveyance rollers (the pair of downstream side conveyance rollers 333, hereinafter, simply referred to as the pair of conveyance rollers 333 in this example) that are at a position of conveying the sheet together with the pair of separable contact rollers 341 are provided. The position is more on the upstream side than the pair of separable contact rollers 341 in the conveyance direction Y1 of the sheet (the document G in this example). In this configuration, the sheet can be conveyed as long as it is passing through the pair of conveyance rollers 333. Even if the pair of separable contact rollers 341 become separated unintentionally for some reason, the ON control is performed during the sheet conveyance period (the document conveyance period α in this example) (see FIG. 14) in which the pair of conveyance rollers 333 convey the sheet (the document G in this example). Thus, the pair of separable contact rollers 341 can certainly return to the pressure-contact state from the separated state.

In other words, in the second embodiment, the fixed ON/OFF control includes the second ON control of turning the solenoid 370 ON for the second ON time ton2 (see FIG. 13) in the sheet conveyance period (the document conveyance period α in this example). Thus, even if the pair of separable contact rollers 341 become separated unintentionally for some reason, the pair of separable contact rollers 341 can be certainly returned to the pressure-contact state from the separated state during the sheet conveyance period (the document conveyance period α in this example). Therefore the pair of separable contact rollers 341 can certainly convey the sheet passing therethrough.

In the second embodiment, the second ON time ton2 is longer than the first ON time ton1. Thus, the pair of separable contact rollers 341 can more certainly return to the pressure-contact state from the separated state. Therefore, the pair of separable contact rollers 341 can more certainly convey the sheet passing therethrough.

In a period during which the trailing edge G2 (an upstream side end in the conveyance direction Y1) of the document G (a document image area in particular) conveyed by the pair of conveyance rollers 333 is positioned more on the upstream side than the reading position β1 (see FIG. 14) for the document G in the sheet conveyance period (the document conveyance period α in this example), when the second ON control is performed, if the pair of separable contact rollers 341 become separated unintentionally for some reason, the impact when the pair of separable contact rollers 341 return from the separated state to the pressure contact state may affect the read image of the document G read at the reading position β1.

In view of this, in the second embodiment, the second ON control is performed in the specific period β during which the trailing edge G2 (an upstream side end in the conveyance direction Y1) of the document G conveyed by the pair of conveyance rollers 333 is positioned between the reading position β1 for the document G and the nip position β2 (see FIG. 14) of the pair of conveyance rollers 333 in the sheet conveyance period (the document conveyance period α in this example). Thus, when the pair of separable contact rollers 341 return to the pressure-contact state from the separated state, the trailing edge G2 of the document G conveyed by the pair of conveyance rollers 333 has passed through the reading position β1 for the document G. All things considered, even if the pair of separable contact rollers 341 become separated unintentionally for some reason, it is possible to avoid the influence on the read image of the document G read at the reading position β1 of the impact when the pair of separable contact rollers 341 return from the separated state to the pressure contact state.

In the third embodiment and the fourth embodiment, the PWM duty control is performed in at least one of the separation-to-pressure-contact transition period Ts (see FIG. 15) and the pressure-contact-to-separation transition period Te (see FIG. 16). Thus, the operating noise of the solenoid 370 can be prevented from being generated when the pair of separable contact rollers 341 in the separated state transition to the pressure-contact state. Furthermore/alternatively, the operating noise of the solenoid 370 can be prevented from being generated when the pair of separable contact rollers 341 in the pressure-contact state transition to the separated state.

More specifically, the gradually changed ON/OFF control is performed in at least one of the separation-to-pressure-contact transition period Ts and the pressure-contact-to-separation transition period Te. In the gradually changed ON/OFF control, the third ON control and the second OFF control are repeated. The third ON control is performed to turn the solenoid 370 ON for the third ON time ton3 (see FIG. 15 and FIG. 16) that gradually changes. The second OFF control is performed to turn the solenoid 370 OFF for the predetermined fixed second OFF time toff2 (see FIG. 15 and FIG. 16). Thus, the operating noise of the solenoid 370 can be more effectively prevented from being generated when the pair of separable contact rollers 341 in the separated state transition to the pressure-contact state. Furthermore/alternatively, the operating noise of the solenoid 370 can be further prevented from being generated when the pair of separable contact rollers 341 in the pressure-contact state transition to the separated state.

In the third embodiment, the gradually changed ON/OFF control performed in the separation-to-pressure-contact transition period Ts (see FIG. 15) is control of gradually increasing the third ON time ton3 (see FIG. 15). Thus, the operating noise of the solenoid 370 can be further prevented from being generated when the pair of separable contact rollers 341 in the separated state transition to the pressure-contact state.

In the third embodiment, the control of gradually increasing the third ON time ton3 is performed between the minimum start time t1min (see FIG. 15) shorter than the first ON time ton1 and the maximum end time t1max (see FIG. 15) longer than the first ON time ton1. Thus, the operating noise of the solenoid 370 can be certainly prevented from being generated when the pair of separable contact rollers 341 in the separated state transition to the pressure-contact state.

In the fourth embodiment, the gradually changed ON/OFF control performed in the pressure-contact-to-separation transition period Te (see FIG. 16) is control of gradually decreasing the third ON time ton3 (see FIG. 16). Thus, the operating noise of the solenoid 370 can be further prevented from being generated when the pair of separable contact rollers 341 in the pressure-contact state transition to the separated state (especially, the operating noise due to collision between the distal end 371*a* of the plunger 371 and the first regulating member 306*a* (see FIG. 5 to FIG. 7)).

In the fourth embodiment, the control of gradually decreasing the third ON time ton3 is performed between the maximum start time t2max (see FIG. 16) longer than the first ON time ton1 and the minimum end time t2min (see FIG. 16) shorter than the first ON time ton1. Thus, the operating noise of the solenoid 370 can be certainly prevented from being generated when the pair of separable contact rollers 341 in the pressure-contact state transition to the separated state.

In the fourth embodiment, the control of gradually decreasing the third ON time ton3 includes the third OFF control of turning the solenoid 370 OFF for the third OFF time toff3 (see FIG. 16) immediately before the maximum start time t2max. Thus, in the third OFF time toff3, the driving canceling of the solenoid 370 can be smoothly started, and therefore the driving cancel operation of the solenoid 370 can be more certainly guaranteed.

In the fourth embodiment, the third OFF time toff3 is longer than the maximum start time t2max. Thus, in the third OFF time toff3, the driving canceling of the solenoid 370 can be more smoothly started, and therefore the driving cancel operation of the solenoid 370 can be more certainly guaranteed.

The present invention is not limited to the above-described embodiments and can be implemented in various other forms. These embodiments are provided by way of example and are not construed in a limited sense. The scope of the present invention is defined by the appended claims and is not restricted by the specification in any manner. Furthermore, modifications and changes belonging to the equivalents of the claims are within the scope of the present invention.

What is claimed is:

1. A sheet conveyance device comprising:

a pair of separable contact rollers configured to convey a sheet;

a contact-separation mechanism configured to support the pair of separable contact rollers in such a manner that the pair of separable contact rollers are able to come into separable contact with each other;

a solenoid configured to operate the contact-separation mechanism; and a controller that controls operation of the solenoid;

wherein the solenoid is turned ON so that the contact-separation mechanism causes the pair of separable contact rollers to come into pressure contact with each other, and the solenoid is turned OFF so that the contact-separation mechanism causes the pair of separable contact rollers to be separated from each other, and wherein pulse width modulation duty control is performed on the solenoid when a plurality of the sheets are conveyed one by one at an interval, wherein the duty control includes ON-OFF control of repeating a first ON control of turning the solenoid ON for a first ON time and a first OFF control of turning the solenoid OFF for a first OFF time in a pressure-contact period in which the pair of separable contact rollers are in a pressure-contact state, and wherein, when no sheet passes through the pair of separable contact rollers at an interval of two sheets sequentially conveyed, the pair of separable contact rollers are in pressure contact with each other so as to maintain the pressure-contact state of the pair of separable contact rollers during the interval of the two sheets sequentially conveyed.

2. The sheet conveyance device according to claim 1, wherein the first ON time is longer than the first OFF time.

3. The sheet conveyance device according to claim 1 further comprising a pair of conveyance rollers disposed at a position for cooperating with the pair of separable contact rollers to convey the sheet, the position being disposed more on an upstream side than the pair of separable contact rollers in a conveyance direction of the sheet, and wherein the ON-OFF control includes a second ON control of turning the solenoid ON for a predetermined second ON time in a sheet conveyance period during which the pair of conveyance rollers convey the sheet.

4. The sheet conveyance device according to claim 3, wherein the second ON time is longer than the first ON time.

5. The sheet conveyance device according to claim 3 further comprising a document moving reading structure configured to read a document image while moving a document as the sheet, wherein the document moving reading structure includes: the pair of separable contact rollers disposed more on a downstream side than a reading position for the document in a conveyance direction of the document; and the pair of conveyance rollers disposed more on the downstream side than the reading position for the document and more on the upstream side than the pair of separable contact rollers in the conveyance direction, and wherein the second ON control is performed in a specific period in which an upstream side end of the document conveyed by the pair of conveyance rollers in the conveyance direction is positioned between the reading position for the document and a nip position of the pair of conveyance rollers, the specific period being a part of a document conveyance period during which the pair of conveyance rollers convey the document as the sheet.

6. The sheet conveyance device according to claim 1, wherein the pulse width modulation duty control is performed in at least one of a separation-to-pressure-contact transition period in which the pair of separable contact rollers transition from a separated state to a pressure-contact state, and a pressure-contact-to-separation transition period in which the pair of separable contact rollers transition from the pressure-contact state to the separated state.

7. The sheet conveyance device according to claim 6, wherein gradually changed ON-OFF control of repeating a third ON control of turning the solenoid ON for a predetermined third ON time that gradually changes and a second OFF control of turning the solenoid OFF for a predetermined fixed second OFF time is performed in at least one of the separation-to-pressure-contact transition period and the pressure-contact-to-separation transition period.

8. The sheet conveyance device according to claim 7, wherein the gradually changed ON-OFF control performed in the separation-to-pressure-contact transition period is control of gradually increasing the third ON time.

9. The sheet conveyance device according to claim 8, wherein the control of gradually increasing the third ON time is performed between a predetermined minimum start time shorter than the first ON time and a predetermined maximum end time longer than the first ON time.

10. The sheet conveyance device according to claim 7, wherein the gradually changed ON-OFF control performed in the pressure-contact-to-separation transition period is control of gradually decreasing the third ON time.

11. The sheet conveyance device according to claim 10, wherein the control of gradually decreasing the third ON time is performed between a predetermined maximum start time longer than the first ON time and a predetermined minimum end time shorter than the first ON time.

12. The sheet conveyance device according to claim 11, wherein the control of gradually decreasing the third ON time includes a third OFF control of turning the solenoid OFF for a predetermined third OFF time immediately before the maximum start time.

13. The sheet conveyance device according to claim 12, wherein the third OFF time is longer than the maximum start time.

14. An image forming apparatus comprising the sheet conveyance device according to claim 1.

* * * * *